US006776410B2

(12) United States Patent
Fukuda

(10) Patent No.: US 6,776,410 B2
(45) Date of Patent: Aug. 17, 2004

(54) SHEET CONVEYING DEVICE WITH A SHEET STORAGE

(75) Inventor: Minoru Fukuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 232 days.

(21) Appl. No.: 09/745,471

(22) Filed: Dec. 26, 2000

(65) Prior Publication Data

US 2001/0013679 A1 Aug. 16, 2001

(30) Foreign Application Priority Data

Dec. 27, 1999 (JP) ..... 11-368768
May 8, 2000 (JP) ..... 2000-134462

(51) Int. Cl.[7] ..... B65H 3/44
(52) U.S. Cl. ..... 271/207
(58) Field of Search ..... 271/176, 184, 271/298, 303, 207, 402

(56) References Cited

U.S. PATENT DOCUMENTS 4,720,728 A * 1/1988 Kando ..... 399/405
4,784,345 A * 11/1988 Romanowski et al. ... 242/535.1
4,838,497 A * 6/1989 Kramer et al. ..... 242/535.1
5,234,212 A * 8/1993 Dutra, Jr. ..... 271/207
5,383,656 A * 1/1995 Mandel et al. ..... 271/258.01
5,482,265 A * 1/1996 Nakazato et al. ..... 271/242
5,513,013 A * 4/1996 Kuo ..... 358/448
5,709,377 A * 1/1998 Yoshioka et al. ..... 271/9.02
5,887,867 A * 3/1999 Takahashi et al. ..... 271/117
6,125,242 A * 9/2000 Yamada ..... 399/23

FOREIGN PATENT DOCUMENTS

| | | |
|---|---|---|
| JP | 6-234452 | 8/1994 |
| JP | 6-329315 | 11/1994 |
| JP | 8-188265 | 7/1996 |
| JP | 8-320599 | 12/1996 |
| JP | 10-26847 | 1/1998 |
| JP | 10-305956 | 11/1998 |
| JP | 11-127301 | 5/1999 |

* cited by examiner

*Primary Examiner*—Eileen D. Lillis
*Assistant Examiner*—Charles A. Fox
(74) *Attorney, Agent, or Firm*—Oblon, Spivak, McClelland, Maier & Neustadt, P.C.

(57) ABSTRACT

A sheet conveying device of the present invention includes a roll-up guide rotatable about a shaft. When the roll-up guide is shifted to a roll-up position where it intersects a first tray, it rolls up a sheet discharged and stores the sheet in the form of a roll. The roll-up guide allows, when shifted to a pick-up position above the body of the device, the operator of the device to pick up the rolled sheet from the roll-up guide at the operating position in front of the device. The device is easy to operate and is capable of storing a sheet in the form of a roll and allowing the roll to be safely picked up without any damage.

92 Claims, 16 Drawing Sheets

SHEET CONVEYING DEVICE WITH A SHEET STORAGE

BACKGROUND OF THE INVENTION

The present invention relates to a sheet conveying device including a sheet storage capable of rolling up a document driven out of, e.g., an image reading unit and storing it in the form of a roll.

A sheet conveying device capable of conveying an elongate sheet document whose size is, e.g., A4 to A0 in the widthwise direction and double the same in the direction of conveyance is conventional. It is a common practice with such a sheet conveying device to reverse the sheet having been read and then discharge it to a tray mounted on the front part of the device. This configuration allows the operator of the device to pick up the sheet at the operating position. However, it is difficult to reverse a relatively thick, hard sheet having been read. This kind of sheet is usually discharged to an extra tray mounted on the back of the device without being reversed.

There has been proposed a sheet conveying device of the type including a roll-up sheet storage capable of rolling up an elongate sheet discharged and storing it in the form of a roll. This type of sheet conveying device may be constructed to allow the operator of the device to pick up the sheet from the roll-up sheet storage at the front of the device while, e.g., correcting a skew at the same side of the device.

A sheet conveying device with a roll-up sheet storage is taught in, e.g., Japanese Patent Laid-Open Publication No. 10-305956. The device taught in this document includes first stocking means, second stocking means, and guiding means. The first stocking means is partly openable for storing a sheet by rolling it up while the second stocking means stores a sheet in a straight position. The guiding means is positioned in the vicinity of outlet rollers for selectively steering a sheet toward either one of the first and second stocking means in accordance with the length of the sheet. The operator of the device opens part of the first stocking means in order to pick up the rolled sheet. However, the guiding means adjoining the outlet rollers, i.e., an outlet brings about the following problem. When the operator picks up the rolled sheet stored in the first stocking means, the trailing edge of the sheet is apt to contact the casing of the device, which forms a guide path, and be damaged thereby.

Technologies relating to the present invention are also disclosed in, e.g., Japanese Patent Laid-open Publication Nos. 6-234452, 6-329315, 8-188265, 8-320599, 10-26847 and 11-127301.

SUMMARY OF THE INVENTION

It is therefore an object of the present invention to provide a sheet conveying device with a sheet storage easy to operate and capable of storing a sheet in the form of a roll and allowing the roll to be safely picked up.

In accordance with the present invention, a sheet storage to be mounted to a sheet conveying device for conveying and discharging a sheet includes a roll-up storage configured to receive the sheet discharged from the sheet conveying device, roll up the sheet from the leading edge of the sheet, and store the sheet in the form of a roll. A connecting member displaceably connects the roll-up storage to the sheet conveying device. The roll-up storage is connected to the sheet conveying device such that when the roll-up storage is displaced, the trailing edge of the sheet rolled up in the roll-up storage is spaced from the sheet conveying device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of a sheet conveying device in accordance with the present invention will be described hereinafter.

First Embodiment

Figure 1:
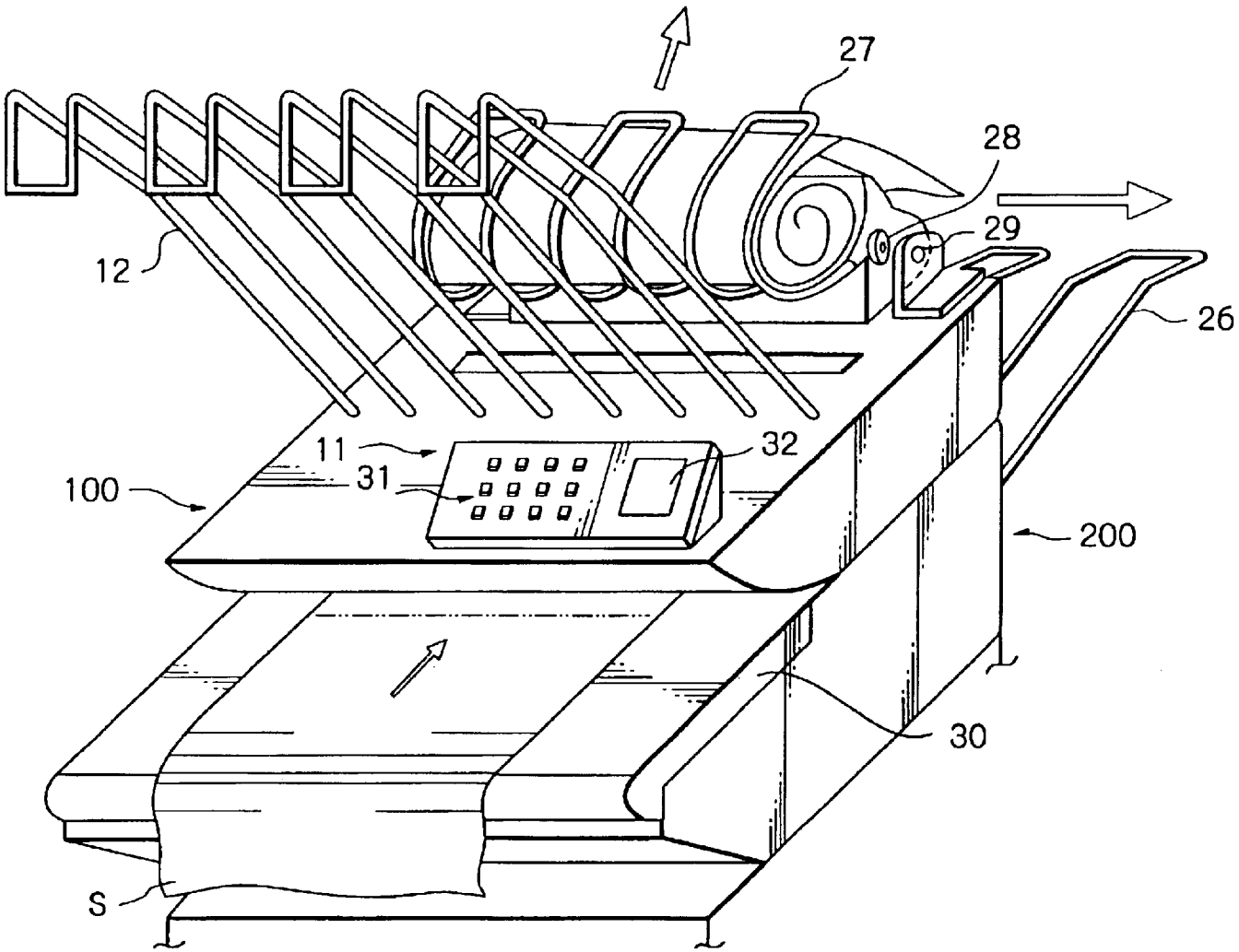
FIG. 1 is a perspective view showing a first embodiment of the sheet conveying device in accordance with the present invention.
Figure 2:
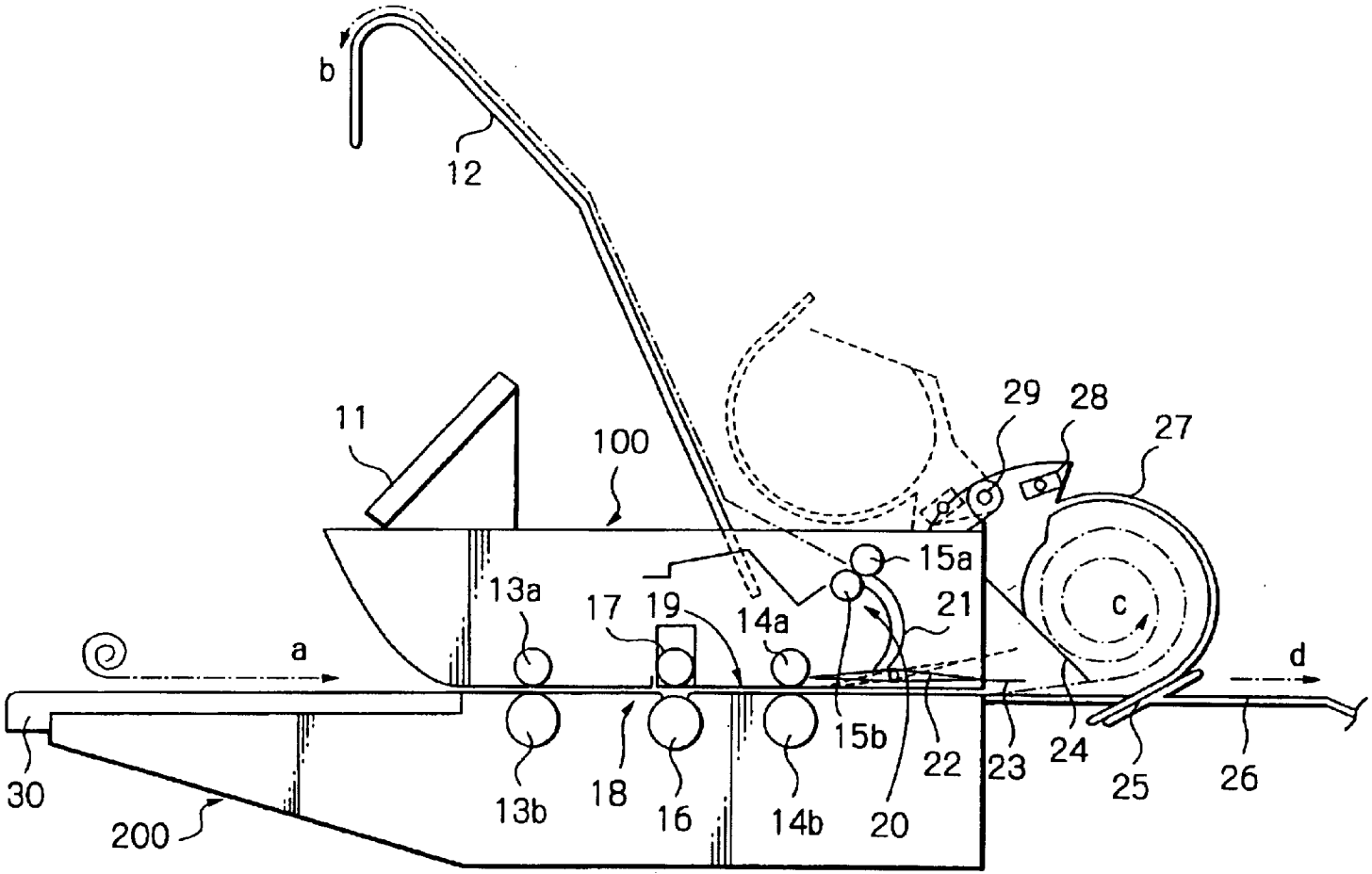
FIG. 2 is a side elevation of the first embodiment.
Figure 3:
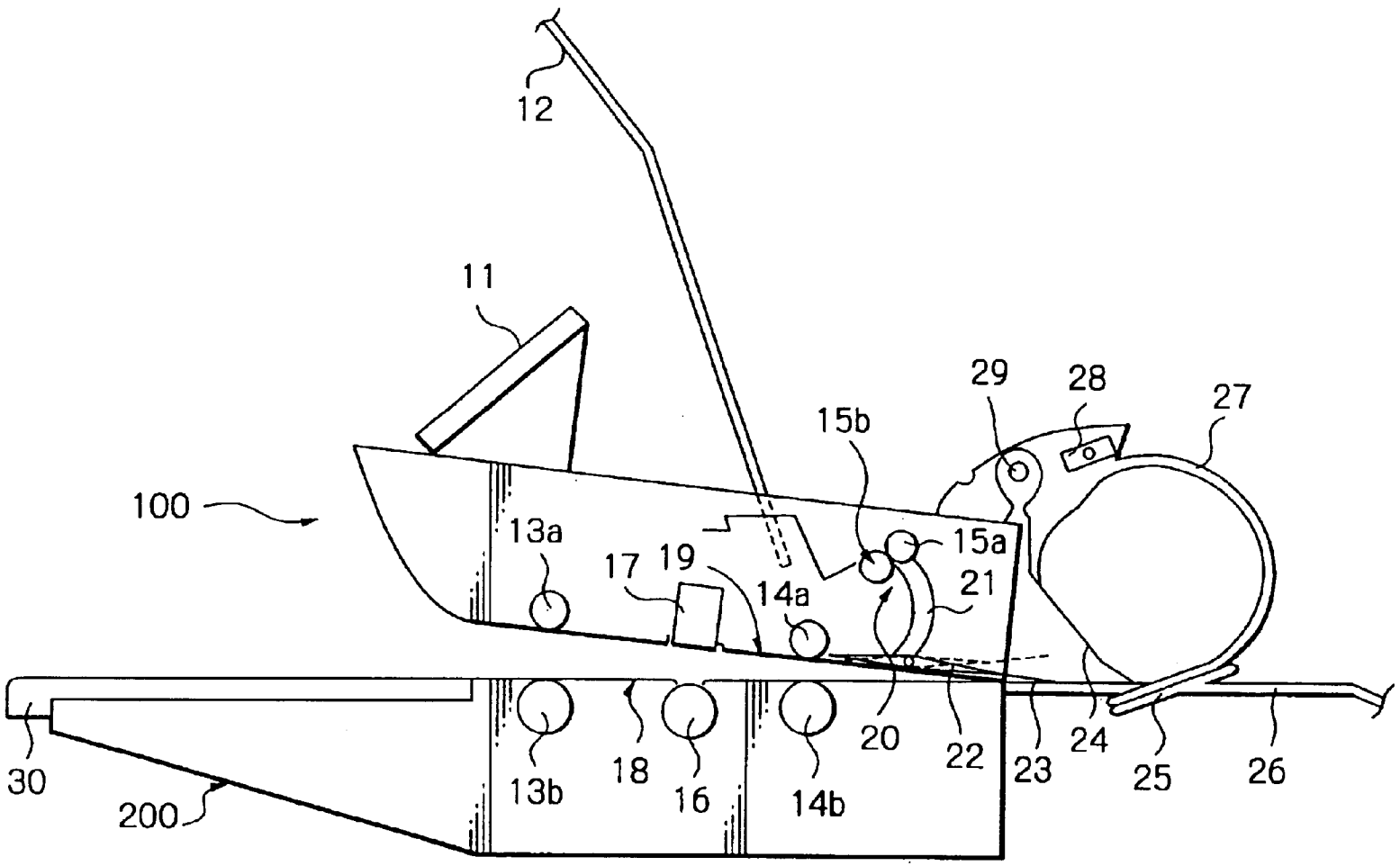
FIG. 3 is a view similar to FIG. 2, showing the device in an open position.

Referring to FIGS. 1 through 3 of the drawings, a sheet converging device embodying the present invention is shown will be described. As shown, the sheet conveying device conveys a sheet (document) S to a reading position and then delivers it to a particular destination in accordance with a mode selected, i.e., a rear discharge mode, a front discharge mode or a roll-up mode. In the rear discharge mode, the device delivers the sheet S having been read to a first tray 26 mounted on the rear (back) thereof. In the front discharge mode, the device delivers the sheet S to a second tray 12 mounted on the front part thereof. Further, in the roll-up mode, the device causes a roll-up guide 27 to roll up the sheet S being delivered toward the first tray 26. After the sheet S has been rolled up by the roll-up guide 27, the operator of the device angularly moves the guide 27 upward in order to pick up the rolled sheet S from the top or the side of the guide 27.

Specifically, the illustrative embodiment is generally made up of an upper unit 100 and a lower unit 200. The upper unit 100 is hinged to the lower unit 200 in such a manner as to be movable toward and away from the lower unit 200. An operation panel 11 and the second tray 12 are mounted on the top of the upper unit 100 and oriented toward the front where the operator is expected to stand. The roll-up guide 27 is mounted on the rear end of the top of the upper unit 100 such that it can be angularly moved by hand between the top and the back of the upper unit 100.

The roll-up guide 27 is connected to the upper unit 100 by connecting means including a support member that supports a shaft 29, so that the guide 27 can be rotated about the shaft 29. More specifically, the operator may operate a knob 28 in order to move the roll-up guide 27 between a roll-up position and a pick-up position. The roll-up position is defined at the rear of the device and adjoins a sheet outlet downstream of a pair of rollers 14*a* and 14*b*. The pick-up position is defined above (front side) the device. At the pick-up position, the top of the upper unit 100 plays the role of a stop for restricting the angular movement of the roll-up guide 27 and thereby maintains a preselected distance between the guide 27 and the second tray 12.

The roll-up guide 27 is made up of a hollow cylindrical portion partly open in the direction of length thereof (direction of width of the sheet S) and a Mylar sheet affixed to one edge of the cylindrical portion. The inner periphery of the cylindrical portion has an arcuate cross-section. The Mylar sheet blocks part of the opening of the cylindrical portion (including the sheet inlet) when the sheet S is rolled up or unblocks the above opening when the rolled sheet S is to be picked up. The inside diameter of the cylindrical portion is selected to be about 125 mm in consideration of a relation between, e.g., friction to act between the sheet S and the inner periphery of the cylindrical portion and the hardness of the sheet S, e.g., thickness and composition.

More specifically, the cylindrical portion of the roll-up guide 27 is implemented by a member formed of plastics and a wire, or guide rod, formed of metal. The wire is configured in the from of the teeth of a comb. In the roll-up position, the wire intersects a wire or guide rod mounted on the first tray 26 and also configured as the teeth of a comb. In addition, the wire in the roll-up position abuts against a wire-like stop 25 mounted on the first tray 26.

The second tray 12 is implemented as a metallic wire in the form of the teeth of a comb and protrudes upward from the rear portion toward the front portion of the upper unit 100, as illustrated. When a second discharge guide 20 steers the sheet S in a direction b, the sheet S is received by the second tray 12 at the front of the device.

A group of keys 31, including a start key and numeral keys, and an LCD (Liquid Crystal Display) or similar display 32 are arranged on the operation panel 11. The operator may set a desired mode and start and stop the operation of the device via the keys 31. Commands input on the keys 31 are sent to a controller 41 (see FIG. 4), which will be described specifically later. A reading section or scanner unit 17 includes mirrors, a light source, a lens, a shading plate, a CCD (Charge Coupled Device) image sensor or similar photoelectric transducer, and a scanner motor although not shown specifically. When the sheet or document S inserted into the front of the device is conveyed along a preselected path, the reading section 17 illuminates the sheet S from above the path. The resulting reflection from the sheet S is incident to the photosensitive surface of the photoelectric transducer via the mirrors and lens. The transducer transforms the incident imagewise light to a corresponding electric image signal (image data).

A first discharge sensor 19 is a reflection type sensor located upstream of the rollers 14*a* and 14*b*, which are, in turn, positioned upstream of a path selector 22. The discharge sensor 19 turns on when the leading edge of the sheet S reaches the rollers 14*a* and 14*b*, and then turns off when the trailing edge of the sheet S moves away from the rollers 14*a* and 14*b*. When the discharge sensor 19 turns off in the roll-up mode, there are executed the return of the path selector 22 and the stop of a conveyance motor 43 (see FIG. 4).

A solenoid, not shown, actuates the path selector 22 in accordance with the mode selected. Specifically, in the front discharge mode, the solenoid maintains the path selector 22 at a home position indicated by a phantom line in FIG. 2. In this position, the path selector 22 steers the sheet S toward a second sheet guide 21. In the rear discharge mode and roll-up mode, the solenoid brings the path selector to a position indicated by a solid line in FIG. 2, so that the sheet S is steered toward the first tray 26.

A Mylar sheet 23 is fitted to the edge of the path selector 22 adjoining the sheet outlet, and extends in the widthwise direction of the sheet S. In the roll-up mode, the Mylar sheet 23 cooperates with the first tray 26 to guide the sheet S such that the sheet S surely enters the inlet of the roll-up guide 27 without any curl. If desired, the Mylar sheet 23 may be replaced with an extension extending from the path selector 22 toward the downstream side. In such a case, the extension and Mylar sheet 24 both are configured like the teeth of a comb in order to prevent the former from contacting the latter.

A second discharge sensor 20 is a reflection type sensor located upstream of a pair of rollers 15*a* and 15*b*. The discharge sensor 20 turns on when the leading edge of the sheet S reaches the rollers 15*a* and 15*b* located downstream of the path selector 22, and then turns off when the trailing edge of the sheet S moves away from the rollers 15*a* and 15*b*. On the turn-off of the discharge sensor 20 in the front discharge mode, the conveyance motor 43 is deenergized.

A sheet table 30 is mounted on the top of the front portion of the lower unit 200. The first tray 26 protrudes rearward from the rear end of the lower unit 200. When the sheet or document S is laid on the sheet table 30 face up and inserted in a direction a, the table 30 guides the sheet S to a nip between a pair of rollers 13*a* and 13*b*.

A registration sensor 18 is a reflection type sensor located upstream of the reading section 17. The registration sensor 18 turns on when the leading edge of the sheet S reaches the reading section 17, and then turns off when the trailing edge of the sheet S moves away from the reading section 17. When the registration sensor 18 turns off in the rear discharge mode, there are executed the return of the path selector 22 and the stop of the conveyance motor 43.

The first tray 26 is inclined upward from the rear end of the lower unit 200 and implemented by a metallic wire configured like the teeth of a comb. The first tray 26 receives the sheet S being driven out in a direction d via a sheet outlet, which is located downstream of the rollers 14*a* and

14*b*. When the roll-up guide 27 is located at the roll-up position, the comb-like wire of the first tray 26 and that of the roll-up guide intersect each other. In this condition, part of the first tray 26 serves as an inlet (guiding means) to the roll-up guide 27.

A rod-like stop (metallic wire) 25 extends on the first tray 26 in the widthwise direction of the sheet S. The stop 25 is inclined upward from the front to the rear in the direction of paper conveyance relative to the upper surface (wire) of the first tray 26. The stop 25 therefore intersects the wire of the tray 26. When the tray 26 and the roll-up guide 27 intersect each other, the wire of the guide 27 abuts against the inclined surface of the stop 25 and is restricted thereby.

As shown in FIG. 3, assume that the operator of the device opens the upper unit 100 away from the lower unit 200 in order to, e.g., remove a jamming sheet. Then, the roll-up guide 27 rotates about the shaft 29 with the result that the wire of the guide 27 slides to the right, as seen in FIG. 3, on the inclined surface of the stop 25. Consequently, the cylindrical portion of the guide 27 maintains its arcuate configuration. At this instant, the cylindrical portion moves slightly downward and causes the Mylar sheet 24 to contact the tray 26 and deform. However, the sheet S does not deform because of the elasticity of the Mylar sheet 24. The Mylar sheet 24 should preferably be positioned on a normal line inclined by an angle of 40 degrees or above relative to a vertical line extending downward from the shaft 29. Should the above angle be smaller than 40 degrees, the stop 25 would deform or fail to smoothly slide on contacting the roll-up guide 27.

The conveyance motor 43 reversibly drives the rollers 13*b*, 14*b* and 15*b* and a backup roller 16, which faces the reading section 17. The conveyance motor 43 is implemented by a stepping motor and applied with a source voltage from the device body. The rollers 13*a*, 14*a* and 15*a* are driven rollers cooperative with the rollers 13*b*, 14*b* and 15*b* for conveying the sheet S.

Figure 4:
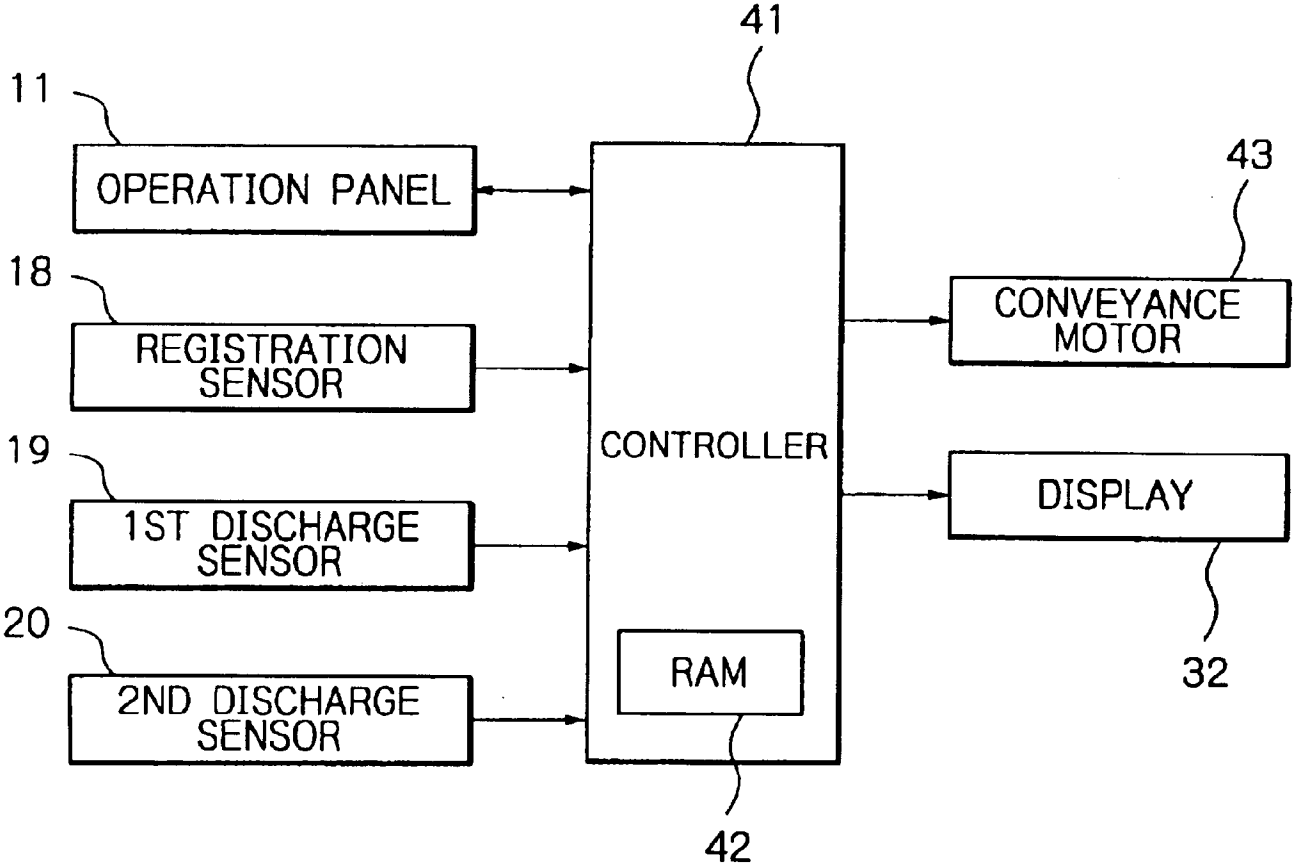
FIG. 4 is a block diagram schematically showing a control system included in the first embodiment.

Referring to FIG. 4, the sensors 18 through 20, conveyance motor 43 and operation panel 11 are connected to the controller 41. The controller 41 executes various processing, e.g., controls the drive of the motor 43 (including speed control) and controls the display 32 in accordance with the outputs of the above constituents. The controller 41 includes a RAM (Random Access Memory) 42 for storing the instantaneous operation modes, which include the front discharge, rear discharge or roll-up mode. Data stored in the RAM 42 are updated every time any one of the modes is replaced with another mode.

Assume that the above-described sheet conveying device is mounted on an image forming apparatus. Then, the illustrative embodiment additionally includes a photoconductive drum, an image forming section, a sheet conveying section, and a sheet receiving section. The image forming section includes a charger, a developing device, image transferring and sheet separating device, a cleaning device and a discharger arranged around the photoconductive drum. The sheet conveying section conveys a paper sheet or similar recording medium toward the drum at a preselected timing. The sheet receiving section receives the paper sheet.

Figure 5:
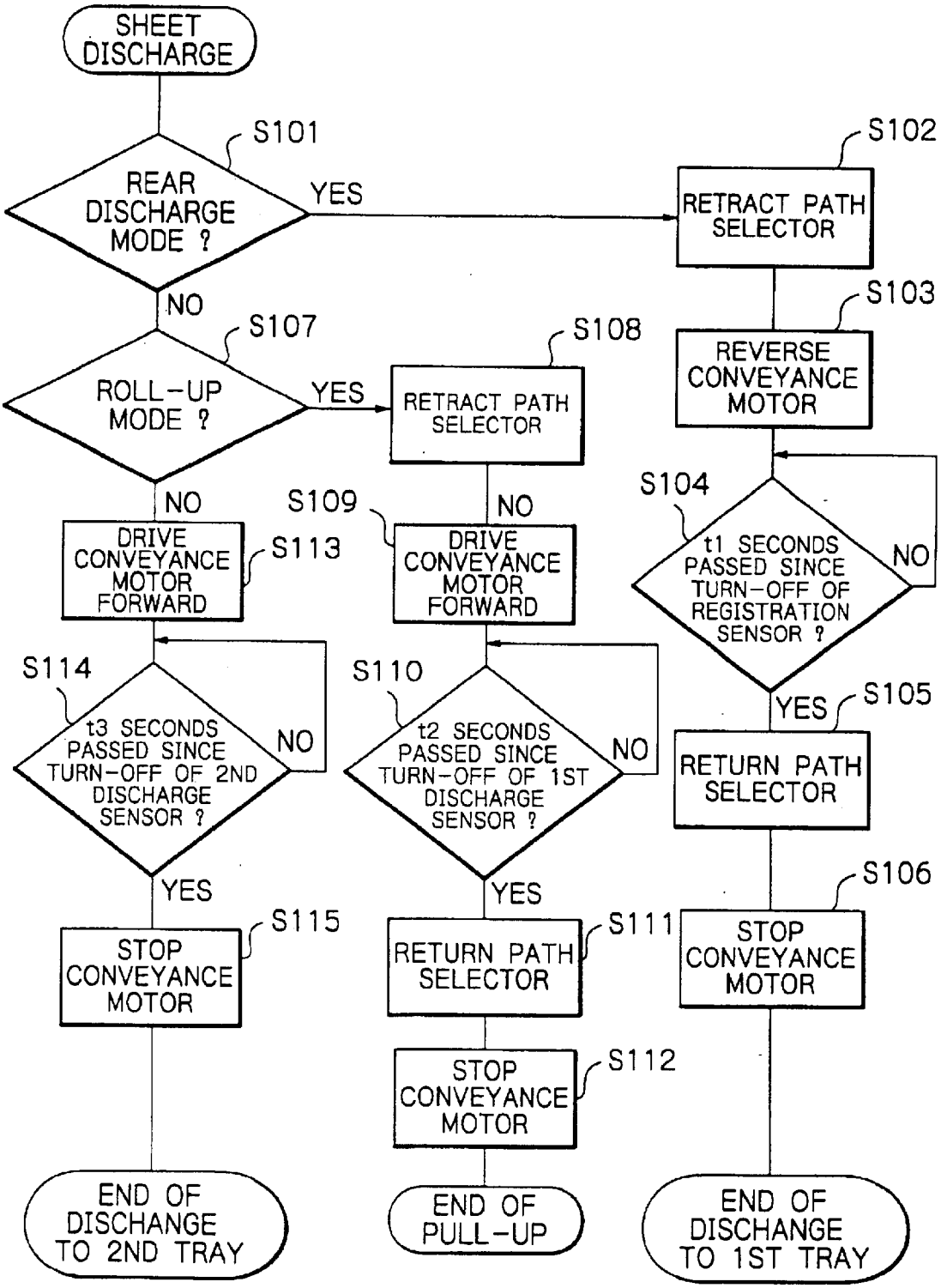
FIG. 5 is a flowchart demonstrating a specific operation of the first embodiment.

Reference will be made to FIG. 5 for describing a specific sheet discharging operation particular to the illustrative embodiment. As shown, assume that the operator selects the rear discharge mode on the operation panel 11 (YES, step S101). Then, the controller 41 causes the previously mentioned solenoid to pull the path selector 22 and retract it from the home position (step S102). The controller 41 then drives the conveyance motor 43 such that the rollers 13*a*, 13*b*, 14*a* and 14*b* and backup roller 16 rotate forward (step S103). In this condition, the sheet S inserted in the direction a face up is conveyed to the reading section 17. After the sheet S has been read by the reading section 17, it is simply driven out of the device to the first tray 26 via the sheet outlet adjoining the path selector 22.

When the trailing edge of the sheet moves away from the reading section 17, the registration sensor 18 turns off and sends its output to the controller 41. In response, the controller 41 determines whether or not t1 seconds have elapsed since the receipt of the output of the sensor 18 (step S104). If the answer of the step S104 is YES, the controller 41 returns the path selector 22 to the home position (step S105) and then deenergizes the conveyance motor 43 (step S106).

In the rear discharge mode, the operator is expected to turn the roll-up guide 27 to the roll-up position above the device via the knob 28. Therefore, the roll-up guide 27 and first tray 26 do not intersect each other, allowing the sheet S to reach the tray 26 in a straight position.

On the other hand, assume that the operator selects the roll-up mode on the operation panel (NO, step S101 and YES, step S107). Then, the controller 41 causes the solenoid to retract the path selector 22 from the home position (step S108). The controller 41 then causes the conveyance motor 43 to rotate the rollers 13*a*, 13*b*, 14*a* and 14*b* and backup roller 16 forward (step S109). As a result, the sheet S inserted in the direction a face up is conveyed to the reading section 17.

After the sheet S has been read by the reading section 17, it is discharged to the first tray 26 via the sheet outlet adjoining the path selector 22. At this instant, the stop 25 positions the sheet S and steers it to the inlet of the roll-up guide 27, which is intersecting with the tray 26. The above inlet is defined between the edge of the Mylar sheet 24 and the edge of the wire that forms the cylindrical portion. The Mylar sheet 23 fitted on the path selector 22 guides the sheet S up to a position adjoining the inlet. This prevents the sheet S from curling or from entering a gap between the Mylar sheet 24 and the back of the upper unit 100.

The leading edge of the sheet S entered the roll-up guide 27 rises along the arcuate inner periphery of the guide 27 and then drops due to its own weight. By repeating such a motion, the sheet S is sequentially rolled up in the roll-up guide 27 with its image surface positioned inside. At the time when the sheet S is fully rolled up, its trailing edge still remains in the casing of the device, i.e., between the sheet outlet and the rollers 14*a* and 14*b*. The operator therefore turns the roll-up guide 27 from the roll-up position to the pick-up position, thereby releasing the trailing edge of the sheet S from the casing. The operator, standing at the front of the device, picks up the rolled sheet S from the above or the side of the roll-up guide 27.

When the trailing edge of the sheet S moves away from the rollers 14*a* and 14*b*, the first discharge sensor 19 turns off and sends its output to the controller 41. In response, the controller 14 determines whether or not t2 seconds have elapsed since the turn-off of the sensor 19 (step S110). If the answer of the step S110 is YES, the Controller 41 returns the path selector 22 to the home position (step S111) and then deenergizes the conveyance motor 43 (step S112).

Assume that the operator selects the front discharge mode on the operation panel 11 (NO, step S101 and NO, step S107) or that a default condition is set. Then, the controller 41 causes the conveyance motor 43 to drive the rollers 13*a* through 15*a* and 13*b* through 15*b* and backup roller 16 forward while maintaining the path selector 22 at the home position (step S113). As a result, the sheet S inserted in the direction a is conveyed to the reading section 17.

The sheet S read by the reading section 17 is steered and reversed by the second sheet guide 21 and then driven out to the second tray 12 by the rollers 15*a* and 15*b*.

When the trailing edge of the sheet S moves away from a position just upstream of the rollers 15*a* and 15*b*, the second discharge sensor 20 turns off and sends its output to the controller 41. In response, the controller 41 determines whether or not t3 seconds have elapsed since the turn-off of the sensor 20 (step S114). If the answer of the step S114 is YES, the controller 41 deenergizes the conveyance motor 43 (step S115).

As stated above, the illustrative embodiment selectively reverses an elongate sheet, which is frequently used, and discharges it to the rear, or rolls up such a sheet and stores it in a compact configuration, or simply discharged a relatively thick, elongate sheet in a straight position. The operator can select any one of such processing in accordance with the thickness, length, width and so forth of a sheet. Particularly, in the roll-up mode, the illustrative embodiment allows the operator, standing at the front of the device, to pick up the rolled sheet from the above or the side of the roll-up guide 27 without damaging the sheet.

Second Embodiment

Figure 6:
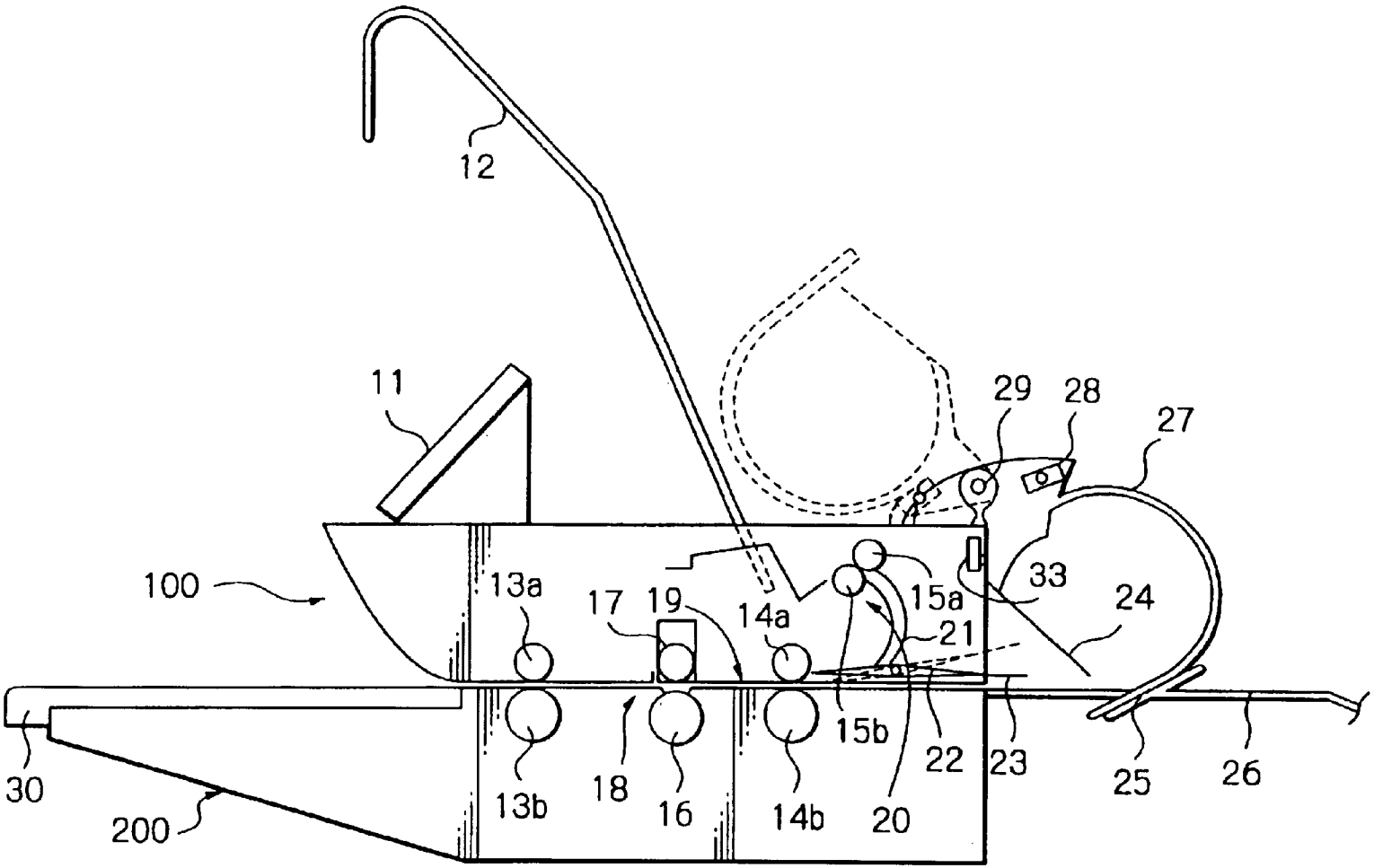
FIG. 6 is a side elevation showing a second embodiment of the present invention.
Figure 7:
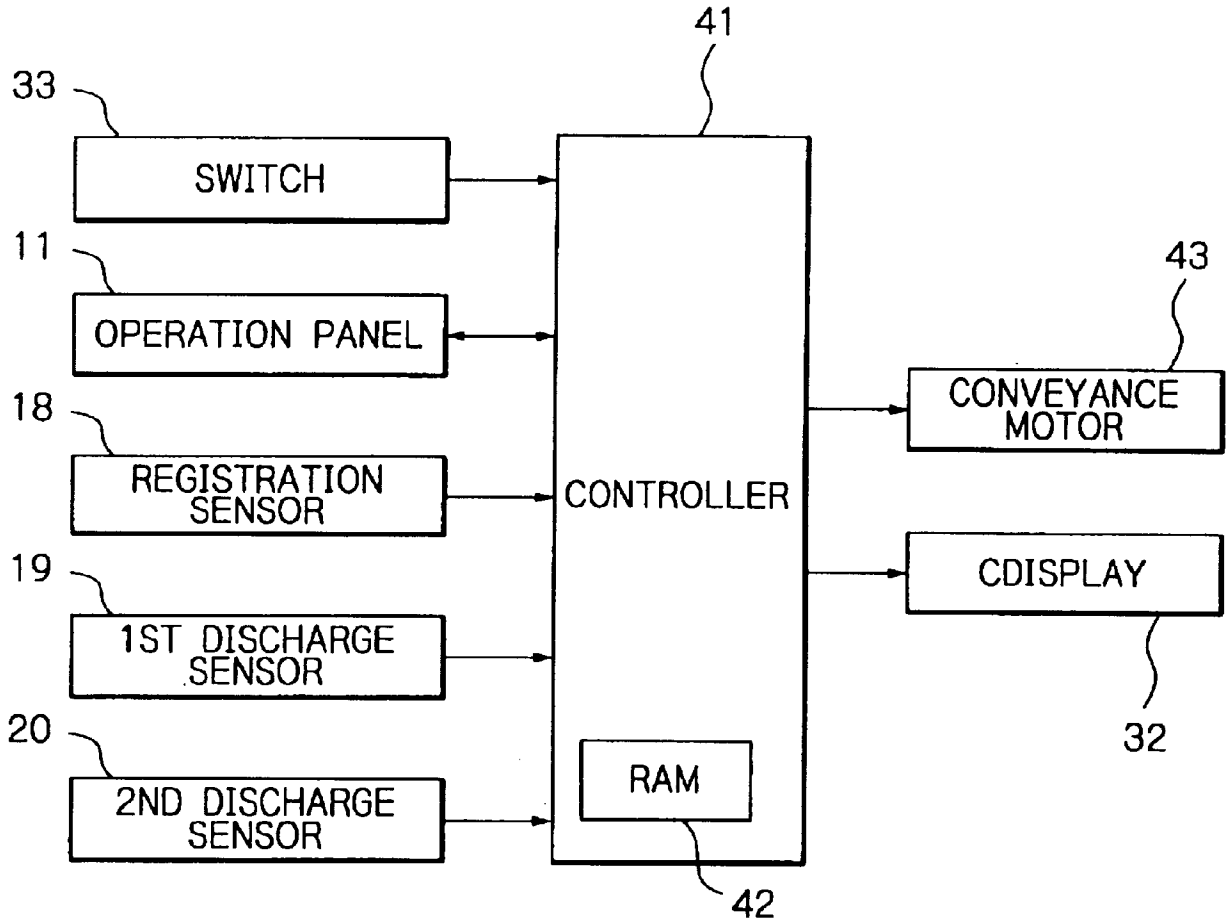
FIG. 7 is a schematic block diagram showing a control system included in the second embodiment.

A second embodiment of the present invention will be described with reference to FIGS. 6 and 7. Structural elements identical with the structural elements of the first embodiment are designated by identical reference numerals and will not be described specifically. As shown, the illustrative embodiment additionally includes a switch or sensor 33 for sensing the roll-up guide 27 brought to its roll-up position. Specifically, the switch 33 turns on when the roll-up guide 27 is positioned by the stop 25 and contacts the back of the upper unit 100 at one end thereof. The switch 33 turns off when the roll-up guide 27 is moved to its pick-up position and contacts the top of the upper unit 100 at the other end thereof. As shown in FIG. 7, the switch 33 is connected to the controller 41. Assume that in the rear discharge mode, the roll-up guide 27 is held at the roll-up position, as indicated by the output of the switch 33. Then, the controller 41 controls the conveyance motor 43 such that the rollers 14*a* and 14*b* nip the trailing edge of the sheet S being driven out to the first tray 25.

Figure 8:
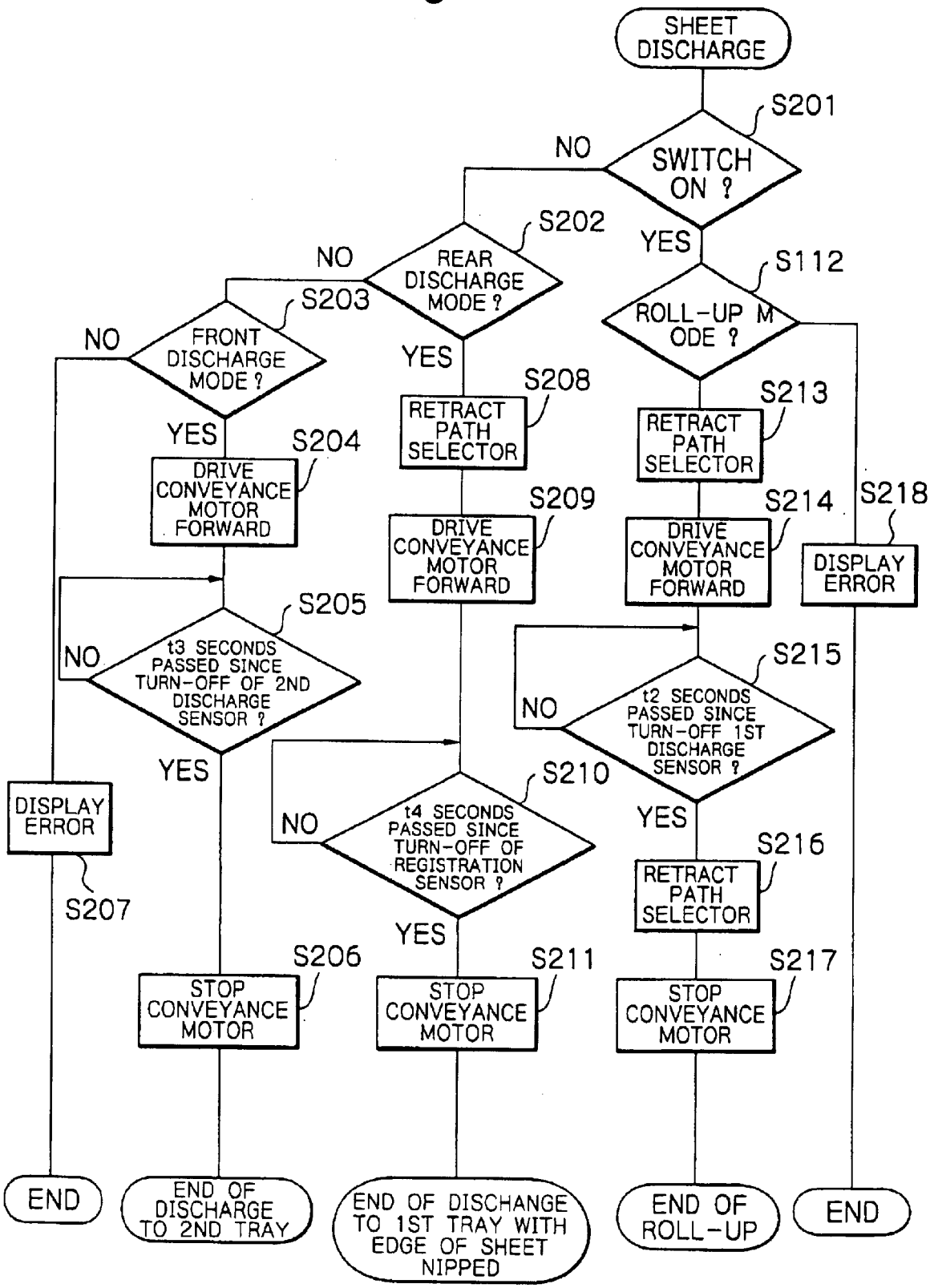
FIG. 8 is a flowchart showing a specific operation of the second embodiment.

A specific operation of the illustrative embodiment will be described with reference to FIG. 8. As shown, assume that the switch 33 is in an OFF state (NO, step S201) and that the rear discharge mode is selected (YES, step S202). Then, the controller 41 retracts the path selector 22 from the home position (step S208) and causes the conveyance motor 43 to rotate forward (step S209), as in the previous embodiment. Consequently, the sheet S inserted in the direction a is conveyed to the reading section 17 and then driven out to the first tray 26 face up in a straight position.

The controller 14 determines whether or not t4 seconds have passed since the registration sensor 18 sensed the trailing edge of the sheet S (step S210). If the answer of the step S210 is YES, the controller 41 deenergizes the conveyance motor 43 while maintaining the path selector 22 in the retracted position (step S211). In the illustrative embodiment, at the time when the motor 43 is deenergized, the rollers 14*a* and 14*b* nip the trailing edge of the sheet S. This allows the sheet S to be surely received by the first tray 26, i.e., prevents it from dropping from the tray 26.

On the other hand, assume that the switch 33 is in an ON state (YES, step 201) and that the roll-up mode is selected (YES, step S212). Then, the controller 41 retracts the path selector 22 from the home position (step S213) and causes the conveyance motor 43 to rotate forward (step S214). Consequently, the sheet S inserted in the direction a is conveyed to the reading section 17 and then guided toward the first tray 26 face up in a straight position. The sheet S is further guided to the inlet of the roll-up guide 25 that is positioned by the stop 25 and intersecting the first tray 26. As a result, the sheet S is rolled up with its image surface positioned inside and stored in the roll-up guide 27 in the form of a roll.

Subsequently, the controller 41 determines whether or not t2 seconds have passed since the first discharge sensor 19 sensed the trailing edge of the sheet S (step S215). If the answer of the step S215 is YES, the controller 41 returns the path selector 22 to the home position (step S216) and then deenergizes the conveyance motor 43 (step S217), as in the previous embodiment.

Further, assume that the switch 33 is in an OFF state (NO, step S201) and that the front discharge: mode is selected (NO, step 202 and YES, step S203). Then, the controller 41 causes the conveyance motor 43 to rotate forward (step S204) while maintaining the path selector 22 at the home position. Consequently, the sheet S inserted in the direction a is conveyed to the reading section 17 and then reversed by the second guide 21 to be driven out to the second tray 12 face down.

The controller 41 then determines whether or not t3 seconds have passed since the second discharge sensor 20 sensed the trailing edge of the sheet S (step S205). If the answer of the step S205 is YES, the controller 41 deenergizes the conveyance motor 43 (step S206).

Assume that the switch 33 is in an OFF state (NO, step S201), but neither one of the front and rear discharge modes is selected (NO, step S202 and NO, step S203), or that the switch 33 is in an ON state (YES, step S201), but the take-up mode is not selected (NO, step S212). Then, the controller 41 displays on the display 32 an alarm message informing the operator of the fact that the position of the roll-up guide 27 and the operation mode do not match (step S207 or S218).

Third Embodiment

Figure 9:
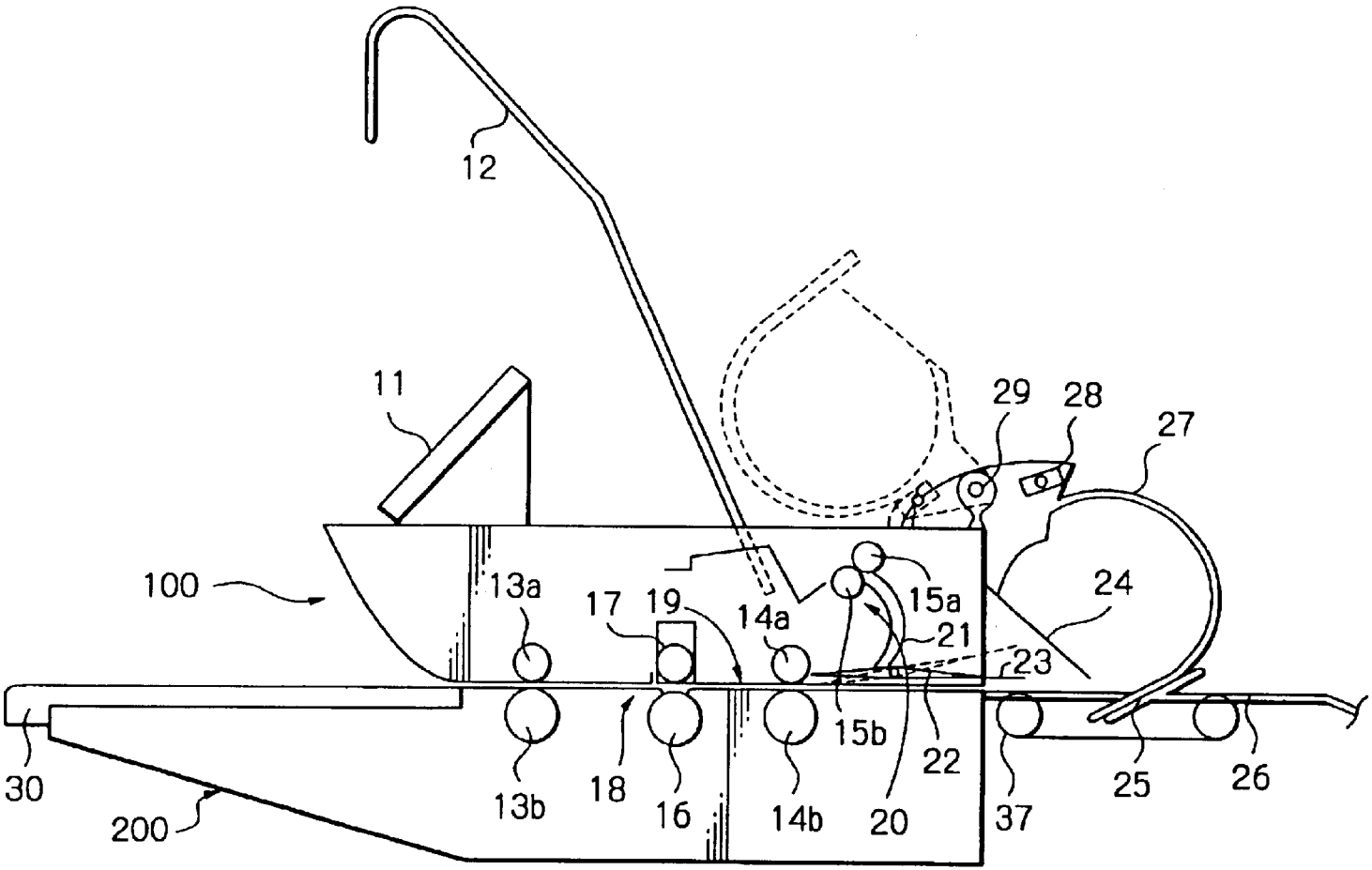
FIG. 9 is a side elevation showing a third embodiment of the present invention.

A third embodiment of the present invention will be described with reference to FIG. 9. Structural elements identical with the structural elements of the first embodiment are designated by identical reference numerals and will not be described specifically in order to avoid redundancy. As shown, an endless belt 37 extends between a position around the upstream end of the first tray 26 and a position around the stop 25. A motor, not shown, drives the belt 37 and is applied with a power source voltage from the device body like the conveyance motor 43.

In the roll-up mode, when a preselected period of time elapses since the first discharge sensor 19 sensed the trailing edge of the sheet S, the controller 41, not shown, energizes the motor not shown. The motor causes the belt 37 to turn in the direction in which the sheet S is driven out to the first tray 26. The belt 37 therefore conveys the sheet S contacting the belt 37, while backing up the sheet S. This allows the Mylar sheet 23 and first tray 26 to surely guide the sheet S up to the inlet of the roll-up guide and thereby prevents the trailing edge of the sheet S from remaining in the portion around the outlet.

It is to be noted that the above-described configuration is similarly applicable to the first and second embodiments.

Fourth Embodiment

Figure 10:
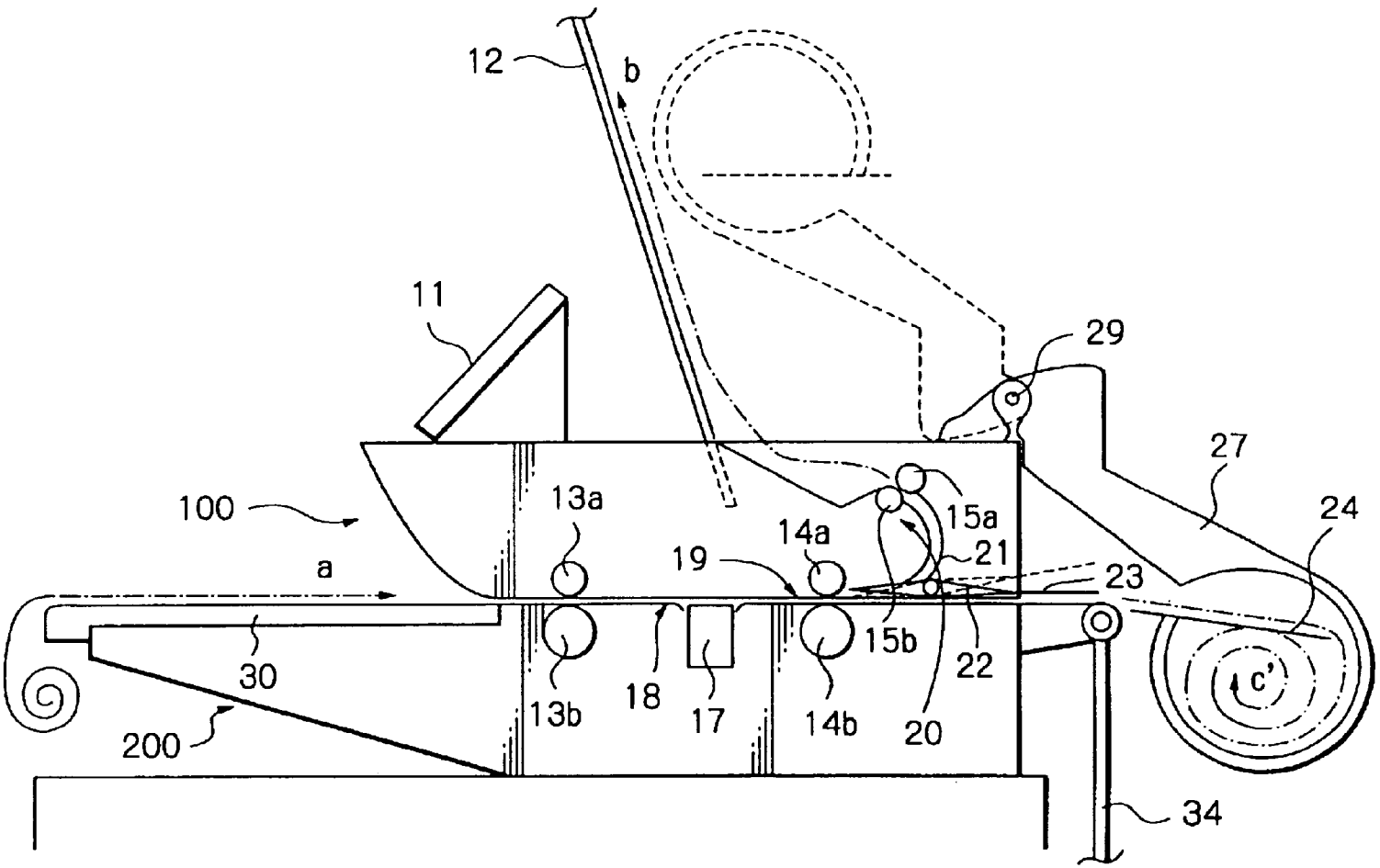
FIG. 10 is a side elevation showing a fourth embodiment of the present invention.

FIG. 10 shows a fourth embodiment of the present invention. Structural elements identical with the structural elements of the first embodiment are designated by identical reference numerals and will not be described specifically in order to avoid redundancy. As shown, the reading section 17 is mounted on the lower unit 200 and reads the sheet S inserted face down in the direction a. The roll-up guide 27 rolls up the sheet S in accordance with the direction of image reading with the image surface of the sheet S being positioned inside.

A first tray 34 protrudes rearward from the lower unit 200 and can be folded downward at a position around the outlet. The roll-up guide 27, which is angularly movable about the shaft 29, is selectively brought to a roll-up position around the bendable portion of the first tray 23 or a pick-up position above the upper unit 100. The back and top of the upper unit 100 respectively serve as a stop in the roll-up position and pick-up position of the roll-up guide 27, restricting the movement of the guide 27.

The roll-up guide 27 is made up of the hollow cylindrical portion and Mylar sheet 24. The cylindrical portion is partly open in the lengthwise direction, i.e., the widthwise direction of the sheet S. The Mylar sheet 24 is fitted on one edge of the cylindrical portion in such a manner as to block part of the opening of the cylindrical portion (including the inlet). In the illustrative embodiment, the Mylar sheet 24 protrudes toward the position around the foldable portion of the first tray 34 so as to guide the sheet S to be rolled toward the bottom of the inner periphery of the cylindrical portion.

In the roll-up mode, the operator folds the first tray 34 downward in order to prevent it from interfering with the roll-up guide 27. At the same time, part of the first tray 34 plays the role of a guide for guiding the sheet S toward the inlet of the roll-up guide 27.

In the illustrative embodiment, in the roll-up mode, the controller 41 accelerates the conveyance of the sheet S to the maximum speed at a preselected timing after the first discharge sensor 19 has sensed the trailing edge of the sheet. This acceleration is similarly applicable to the first and second embodiments.

How the illustrative embodiment discharges the sheet S in the roll-up mode will be described hereinafter. In the roll-up mode, the controller 41 retracts the path selector 22 from the home position and causes the conveyance motor 43 to rotate the rollers 13*a*, 13*b*, 14*a* and 14*b* forward. In this condition, the sheet S inserted in the direction a face down is conveyed to the reading section 17.

After the sheet S has been read by the reading section 17, it is discharged face down via the outlet adjoining the path selector 22. Part of the first tray 34 and Mylar sheet 24 guide the sheet S coming out of the outlet to the inlet of the roll-up guide 27. At this instant, the Mylar sheet 23 fitted on the path selector 22 prevents the sheet S front curling or entering the gap between the Mylar sheet 24 and the support member of the roll-up guide 27.

The leading edge of the sheet S entered the roll-up guide 27 moves downward along the arcuate inner periphery of the guide 27, then rises, and then falls due to its own weight. By repeating such a motion, the sheet S is rolled up and stored in the roll-up guide 27 with the image surface position inside. At the time when the sheet S is fully rolled up, the trailing edge of the sheet S still remains in the casing, i.e., between the outlet and the rollers 14*a* and 14*b*. The operator therefore moves the roll-up guide 27 from the roll-up position to the pick-up position, thereby spacing the trailing edge of the sheet from the casing. The user, standing at the front of the device, picks up the rolled sheet S from the above or the side of the roll-up guide 27.

When the first discharge sensor 19 senses the passage of the trailing edge of the sheet S, the controller 41 increases the sheet conveying speed to the preselected maximum speed. On the elapse of a preselected period of time since the turn-off of the sensor 19, the controller 41 returns the path selector 22 to the home position and stops driving the conveyance motor 43.

Fifth Embodiment

FIG. 11 shows a fifth embodiment of the present invention. Structural elements identical with the structural elements of the first embodiment are designated by identical reference numerals and will not be described specifically in order to avoid redundancy. As shown, a roll-up storage 35 protrudes from the top of the device in order to store the sheet S while rolling it up in the roll-up mode. The sheet S is rolled up and then picked up at the same position adjacent to the operator. The roll-up storage 35 is generally made up of an outside guide 35*a*, an inside guide 35*b*, and a hollow cylinder 35*c*. The outside guide 35*a* and cylinder 35*c* play the role of a tray assigned to the front discharge mode at the same time. This tray corresponds to the second tray 12 shown in FIG. 1.

Specifically, the outside guide 35*a* and inside guide 35*b* cooperate to guide the sheet S reversed by the second discharge guide 21 and then conveyed by the rollers 15*a* and 15*b* into the cylinder 35*c*. The sheet S is rolled up and stored in the cylinder 35*c*. The cylinder 35*c* is open at opposite ends thereof in the widthwise direction of the sheet S. The leading edge of the sheet S entered the cylinder 35*c* rises along the arcuate inner periphery of the cylinder 35*c* due to the conveying force of the rollers 15*a* and 15*b* and then falls due to its own weight. By repeating such a motion, the sheet S is rolled up and stored in the cylinder 35*c*. The roll-up storage 35 is angularly movable about the shaft 29 between a roll-up position and a front discharge position.

Figure 11B:
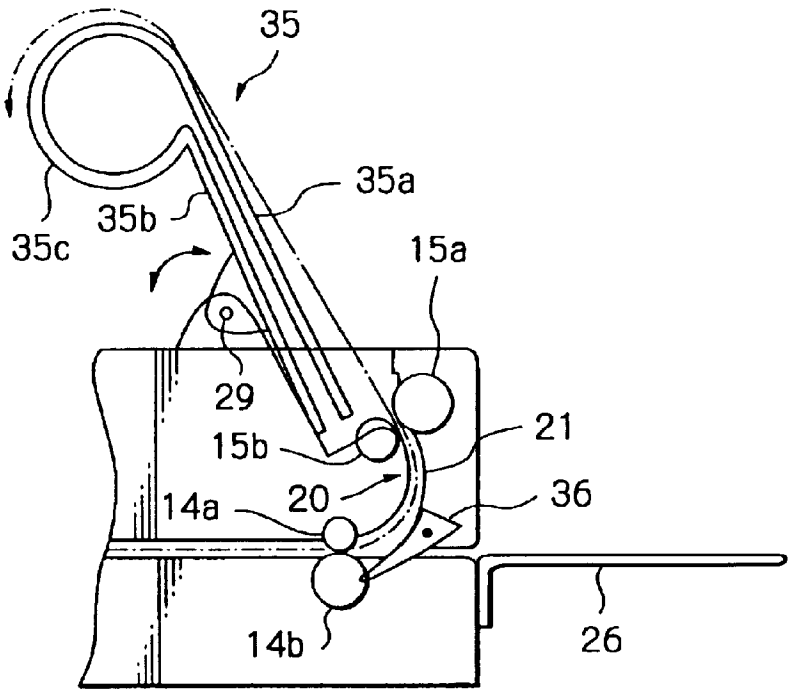
FIGS. 11A and 11B are fragmentary views showing a fifth embodiment of the present invention.
Figure 11A:
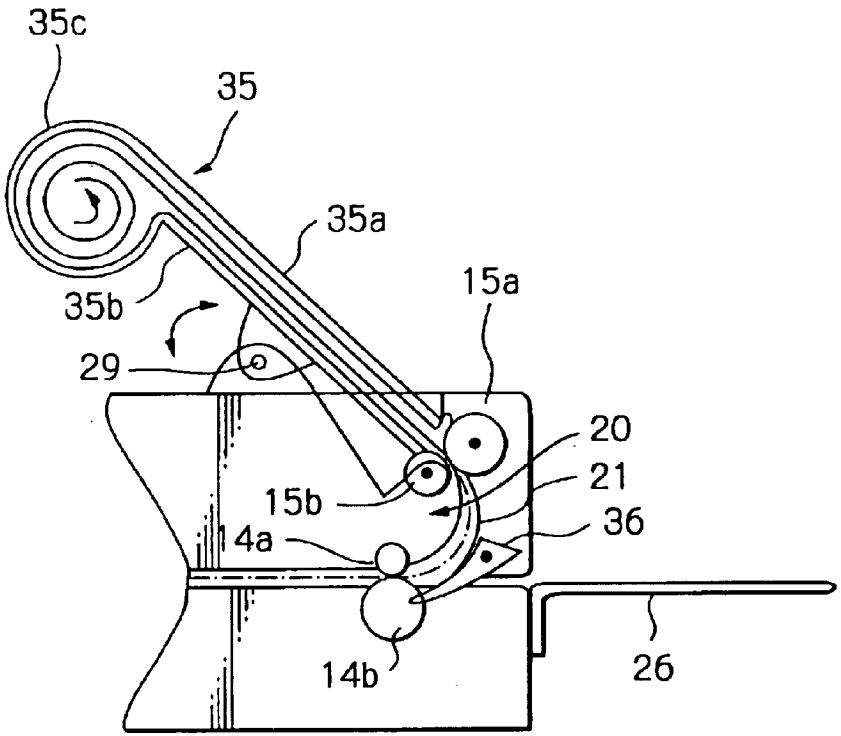

In the front discharge mode and roll-up mode, a solenoid mechanism, not shown, maintains a path selector 36 in a home position shown in FIGS. 11A and 11B. In the home position, the path selector 36 steers the sheet S toward the second discharge guide 21. In the rear discharge mode, the solenoid mechanism retracts the path selector 36 from the home position to a position above the conveyance path, so that the sheet S can be driven out to the first tray 26 in a straight position.

In the roll-up mode, the sheet S being conveyed by the rollers 15*a* and 15*b* enters a gap between the outside guide 35*a* and the inside guide 35*b*. In the front discharge mode, the sheet S is discharged along the outer periphery of the outside guide 35*a* and cylinder 35*c*. The operator is expected to so switch the position of the outside guide 35*a* and inside glide 35*b*.

In operation, in the roll-up mode, the path selector 36 is held in the home position while the roll-up storage 35 is held in the position shown in FIG. 11A. The sheet S is reversed by the second discharge guide 21 and then guided into the cylinder 35*c* by the outside guide 35*a* and inside guide 35*b*. Consequently, the sheet S is rolled up in the cylinder 35*c*, as stated earlier. At the time when the sheet S is fully rolled up, the tailing edge of the sheet S still remains between the outside guide 35*a* and the inside guide 35*b*. The operator therefore turns the sheet roll through the opposite open ends of the cylinder 35*c* in order to fully roll up the remaining portion of the sheet S. The operator then takes out the rolled sheet S via either one of the opposite ends of the cylinder 35*c*.

In the front discharge mode, the path selector 36 is held at the home position while the roll-up storage 35 is located at the position shown in FIG. 11B. The sheet S is reversed by the second discharge guide 21 and then discharged along the outer periphery of the outside guide 35*a* and cylinder 35*c*.

In the rear discharge mode, the path selector 36 is retracted upward while the roll-up storage 35 is located at the position shown in FIG. 11A or 11B. The sheet S is driven out to the first tray 26 via the path selector 36 in a straight position.

Sixth Embodiment

Figure 12:
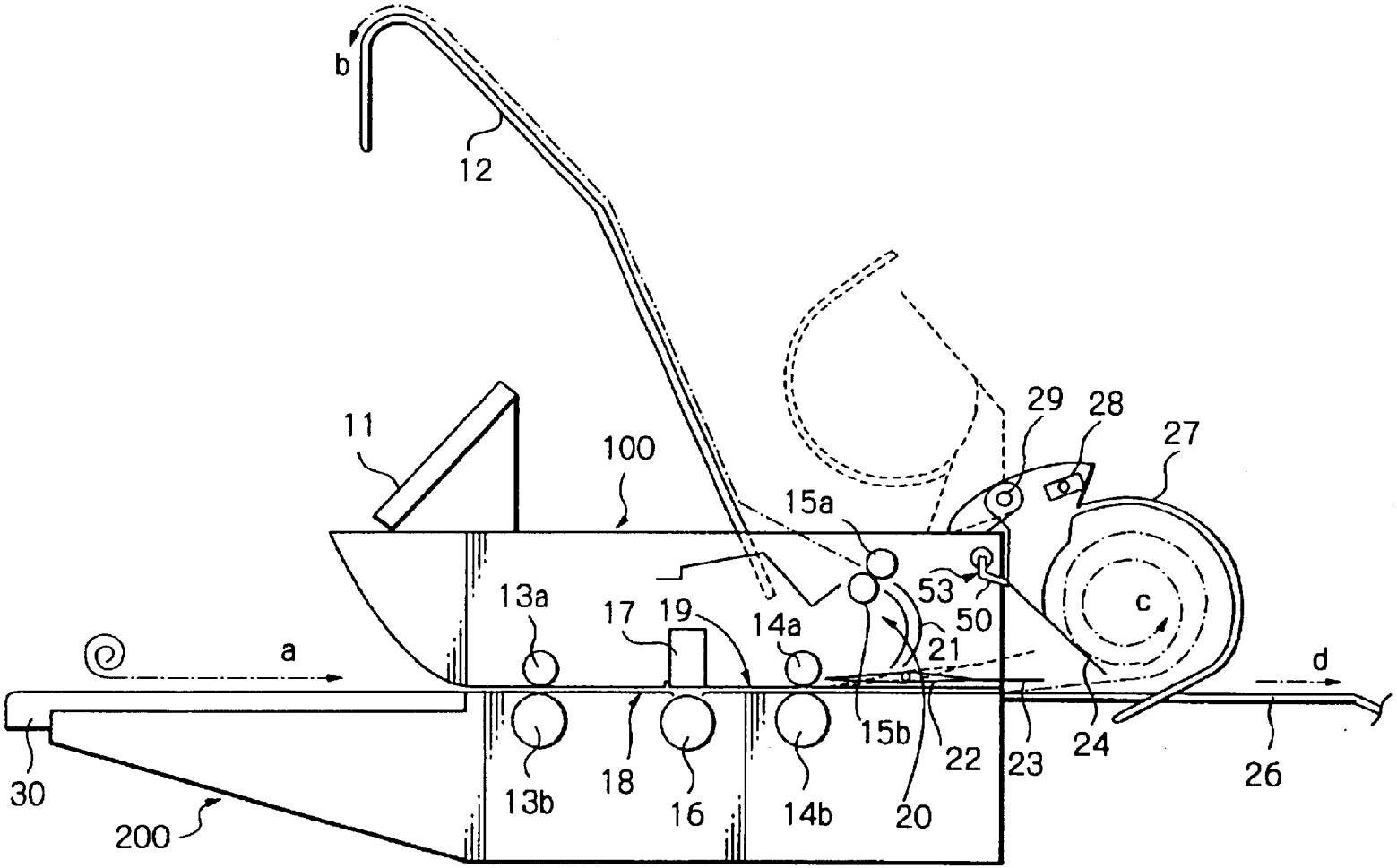
FIG. 12 is a side elevation showing a sixth embodiment of the present invention.
Figure 13:
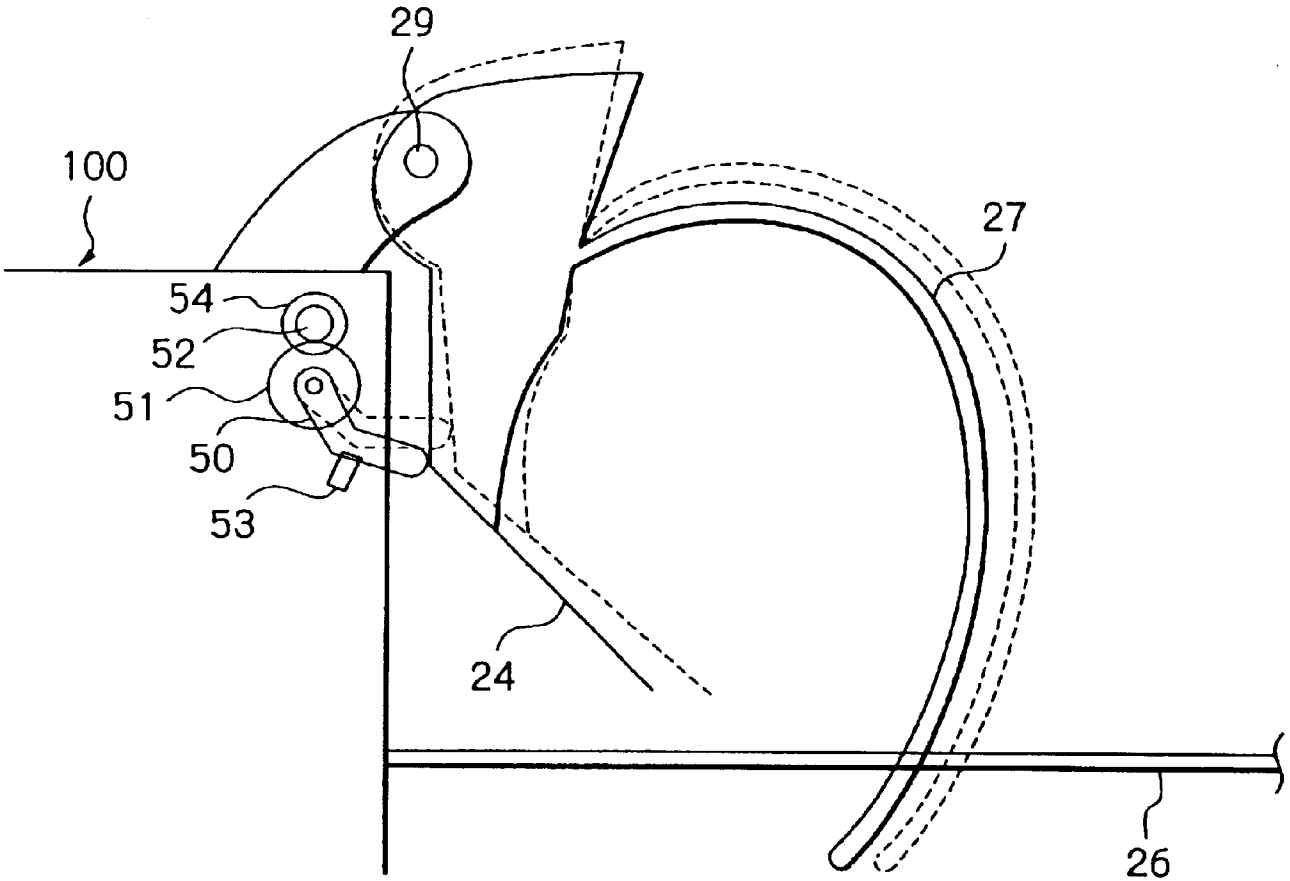
FIG. 13 is a fragmentary enlarged view showing a mechanism included in the sixth embodiment for rotating a roll-up guide.

Referring to FIGS. 12 and 13, a sixth embodiment of the present invention will be described. Structural elements identical with the structural elements of the first embodiment are designated by identical reference numerals and will not be described specifically in order to avoid redundancy. As shown, the illustrative embodiment includes a lever 50 rotatable in contact with the roll-up guide 27 and a sensor 53 responsive to the position of the lever 50.

In the illustrative embodiment, the roll-up guide 27 starts rolling the sheet S at a particular position in accordance with the thickness of the sheet S. Specifically, the roll-up guide 27 starts rolling a relatively thin, soft sheet at a position indicated by a solid line in FIG. 13 or starts rolling a relatively thick, hard sheet at a position indicated by a dotted line in FIG. 13. The relatively thin sheet refers to plain sheets whose weight is, e.g., 52.3 g/m$^2$ or below while the relatively thick sheets refers to plain sheets whose weight is up to, e.g., 127.9 g/m$^2$. The position indicated by the dotted line provides the roll-up guide 27 with a broader roll-up space than the position indicated by the solid line. Stated another way, the roll-up guide 27 is provided with a greater inscribed circle when rolling up a thick sheet than when rolling up a thin sheet.

Figure 14:
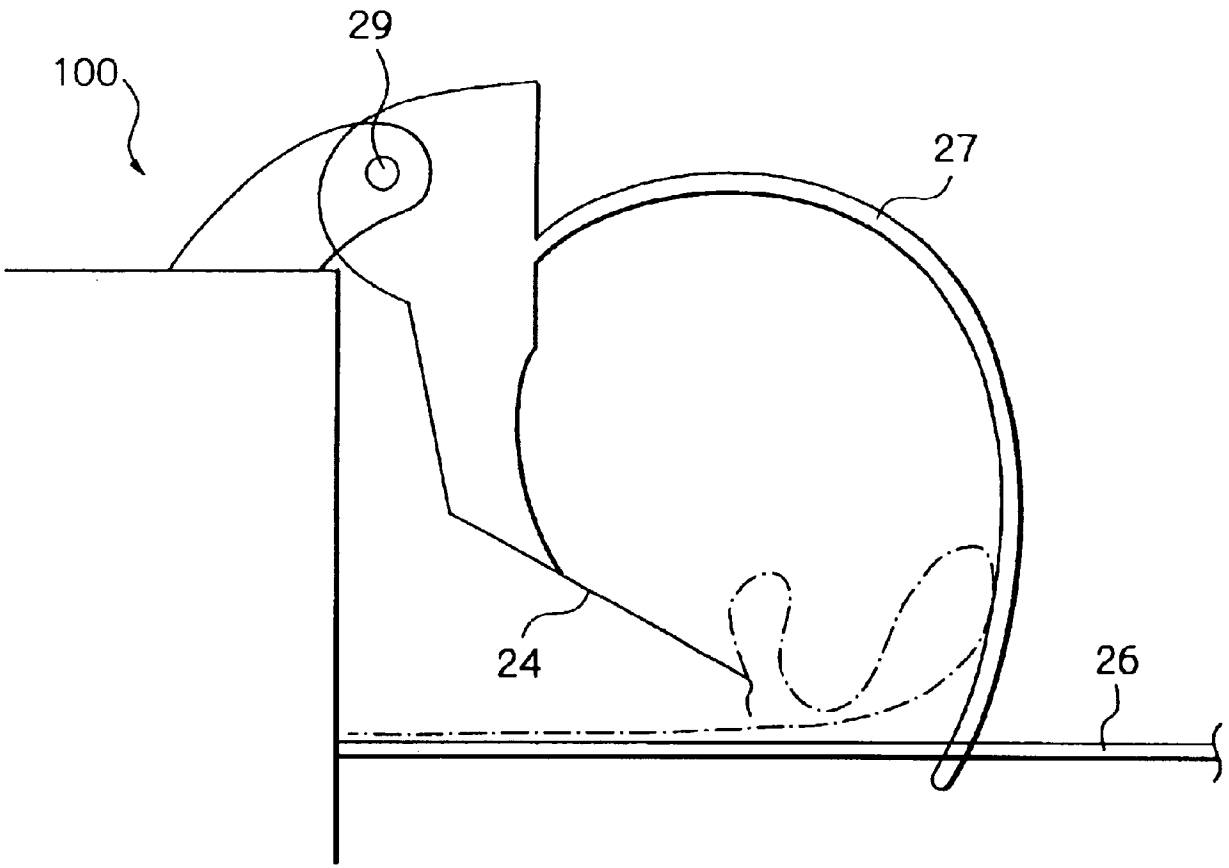
FIG. 14 is a fragmentary enlarged view showing a specific condition wherein a relatively thick sheet has failed to rise along the inner periphery of a guide and collapsed.

More specifically, assume that the inscribed circle is excessively large when the roll-up guide 27 rolls a thin sheet. Then, the sheet fails to fully rise along the inner periphery of the guide 27 and collapses in a folded position, as shown in FIG. 14. On the other hand, assume that the inscribed circle is excessively small when the roll-up guide 27 rolls a thick sheet. Then, the diameter of the sheet (roll) being rolled increases and exerts pressure on the guide 27, increasing frictional resistance between the sheet and the guide 27. As a result, the sheet is apt to bend in the form of bellows and jam the guide 27. In light of the above, the lever 50 is rotated to angularly move the guide 27 and cause the guide 27 to start rolling a sheet at either one of the two preselected positions. The guide 27 is further moved in accordance with the progress of the rolling operation, as will be described specifically later.

As shown in FIG. 13, a gear 51 is mounted on the same shaft as the lever 50. A lever motor 54, which is implemented by a stepping motor, has an output shaft operatively connected to the gear 51 via a gear 52 or similar connecting means. The lever motor 54 causes the lever 50 to rotate via the gears 52 and 51, thereby moving the roll-up guide 27. In a stand-by state or a thin sheet mode, the lever 50 is held at a home position or thin sheet position indicated by a solid line in FIG. 13. In a thick sheet mode. the lever 50 is moved from the home position to a thick sheet position indicated by a dotted line in FIG. 13.

The sensor 53 turns on when the lever 50 is held at the home position. On the turn-on of the sensor 53, the controller 41 determines that the roll-up guide 27 is located at the thin sheet position. The sensor 53 turns off when the operator moves the roll-up guide 27 to the pickup position or when the lever 50 is rotated to move the guide 27 away from the home position. The output of the sensor 53 is also sent to the controller 41.

When the roll-up guide 27 is held at the roll-up position in the rear discharge mode, the controller 41 controls the conveyance motor 43 such that the rollers 14*a* and 14*b* nip the trailing edge of the sheet S being discharged toward the first tray 25.

The operator inputs desired one of the thick sheet mode, thin sheet mode and roll-up mode on the operation panel 11. The controller 41 rotates the lever 50 via the motor 54 in accordance with the mode input on the operation panel 11 and the output of the sensor 53, so that the roll-up guide 27 is shifted in order to enlarge or reduce the roll-up space for accommodating the sheet S. The mode selected on the operation panel 11 is written t4 the 42 of the controller 41 and updated every time the mode is changed.

In operation, assume that the operator selects the thin sheet mode or the roll-up mode on the operation panel 11. Then, the controller 41 retracts the path selector 22 from the home position and causes the conveyance motor 43 forward. When the output of the sensor 53 indicates that the lever 50 is in its home position, the controller 41 causes the roll-up guide 27 to remain at the thin sheet position.

The sheet S inserted in the direction a is conveyed to the reading section 17 and then delivered to the first tray 26 in a straight position face up. After the first discharge sensor 19 has sensed the trailing edge of the sheet S, the sheet is rolled in the roll-up guide 27. As soon as the sheet 27 is rolled by a single turn, the controller 41 drives the lever motor 54 and therefore the lever 50 such that the inscribed circle increases little by little during rolling. On the elapse of a preselected period of time since the trailing edge of the sheet S moved away from the rollers 14*a* and 14*b* via the first discharge sensor 19, the controller 41 reverses the lever motor 54 by a preselected amount in order to return the lever 50 to the home position. As a result, the roll-up guide 27 returns to the thin sheet position or home position.

On the other hand, assume that the operator selects the thick sheet mode or the roll-up mode on the operation panel 11. Then, if the output of the sensor 53 indicates that the lever 50 is held at the home position, the controller 41 drives the lever motor 54 by a preselected number of pulses. The lever motor 54, in turn rotates the lever 50 counterclockwise, as viewed in FIGS. 12 and 13, by a preselected angle away from the home position. Consequently, the roll-up guide 27 is shifted to the thick sheet position indicated by the dotted line in FIG. 13.

The sheet S is rolled by a single turn in the roll-up guide 27 on the elapse of a preselected period of time, a stated earlier. Then, the controller 41 drives the lever 50 via the lever motor 54 such that the inscribed circle increases little by little during rolling. Further, on the elapse of a preselected period of time since the trailing edge of the sheet S has moved away from the rollers 14*a* and 14*b* via the first discharge sensor 19, the controller 41 causes the lever 50 to rotate clockwise, as viewed in FIGS. 12 and 13, by a preselected angle by reversing the lever motor 54. Consequently, the roll-up guide 27 returns to the thick sheet position.

After the sheet S has been rolled up in the roll-up guide 27, the operator shifts the guide 27 to the previously stated pick-up position.

The conveyance motor 43 assigned to the rollers 14*a* and 14*b* and the lever motor 54 assigned to the lever 50 each are implemented by a stepping motor. It is therefore possible to determine, e.g., the length of the rolled part of the sheet S by multiplying the amount of conveyance for a single step of the stepping motor by the number of pulses (steps) fed to the motor. Therefore, there can be easily determined, e.g., the time when the sheet is rolled by a single turn in the roll-up guide 27 after the first sensor 19 has sensed the leading edge of the sheet S.

A In the rear discharge mode, the controller 41 retracts the path selector 22 from the home position and causes the conveyance motor 43 to rotate forward, as stated earlier. As a result, the sheet S is driven out to the first tray 26 in a straight position face up. In the front discharge mode, the controller 41 causes the conveyance motor 43 to rotate forward while maintaining the path selector 22 at the home position. Consequently, the sheet S is reversed by the second discharge guide 21 and then driven out to the second tray 12 face down. Further, assume that the sensor 53 is in an ON state, but the roll-up mode is not selected, or that the sensor 53 is in an ON state, but the thick sheet mode is selected. Then, the controller 41 may display on the display 32 an alarm message informing the operator of the fact that the position of the roll-up guide 27 and the operation mode do not match.

As stated above, the illustrative embodiment shifts the roll-up guide 27 stepwise in accordance with the thickness of the sheet S and the rolled length of the same. This, coupled with the fact that the space for rolling up the sheet S continuously increases, prevents the guide 27 from failing to roll up a thin sheet or causing a thick sheet to collapse and jam the guide 27.

In the illustrative embodiment, the controller 41 causes the roll-up space to be automatically enlarged or reduced in accordance with the output of the sensor 53. Alternatively, a click mechanism may be operated by hand to vary the roll-up space stepwise. Also, three or more different positions for rolling the sheet S may be assigned to the roll-up guide 27. Further, a plurality of sensors responsive to the position of the lever 50 may be used such that when the position of the roll-up guide and the mode do not match, an alarm message is displayed and/or the operation is interrupted. The illustrative embodiment is similarly applicable to the first and second embodiments.

Embodiments to be described hereinafter each include an anti-twist mechanism for preventing the sheet S being rolled in the roll-up guide 27 from twisting in accordance with the size of the sheet S.

Seventh Embodiment

Figure 15A:
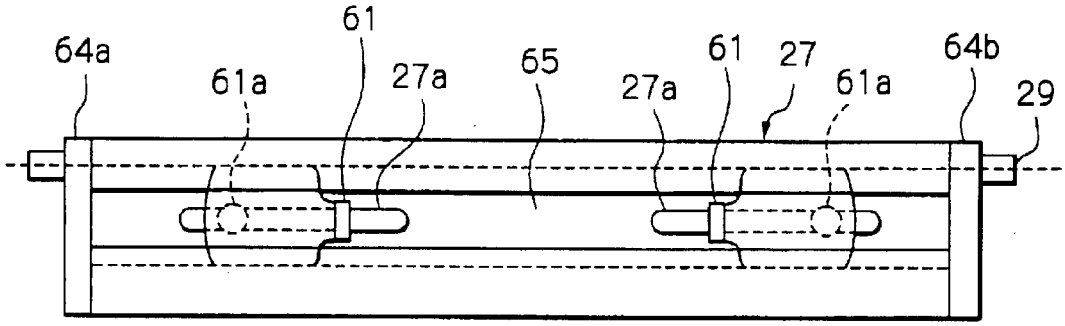
FIGS. 15A through 15C are views showing an anti-twist mechanism included in a seventh embodiment of the present invention.
Figure 15B:
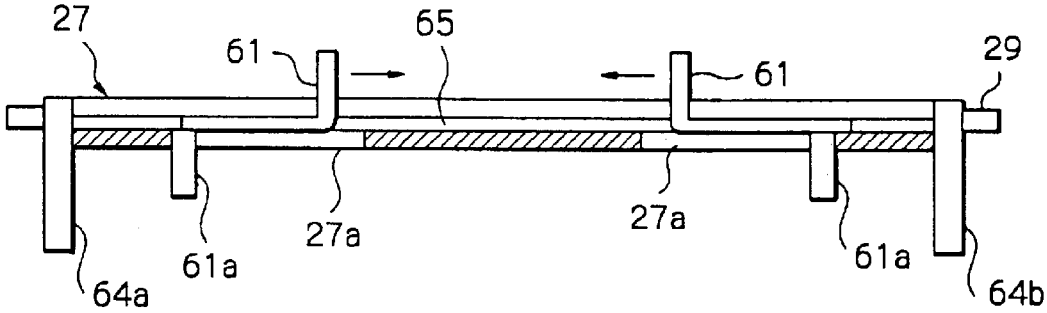
Figure 15C:
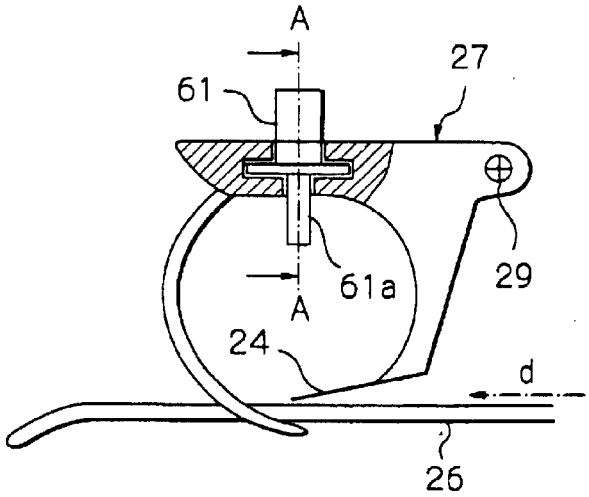

FIG. 15A is a plan view showing the roll-up guide 27 representative of a seventh embodiment of the present invention and including an anti-twist mechanism. FIG. 15B is a section as seen in a direction A of FIG. 15A. FIG. 15C is a side elevation of the anti-twist mechanism. As shown, the roll-up guide 27 includes a channel 65 extending between opposite end walls 64*a* and 64*b*. A pair of anti-twist members 61 are received in the channel 65 and slidable in the widthwise direction. A pin 61*a* is studded on each anti-twist member 61 and protrudes to the inside of the guide 27 via an elongate slot 27*a*, which is formed in the bottom of the channel 65.

When the two anti-twist members 61 are slid along channel 65, the pins 61*a* studded on the members 61 each slide in the respective elongate slot 27*a*. The pins 61*a* therefore restrict the sheet S in the widthwise direction within the roll-up guide 27.

Eighth Embodiment

Figure 16:
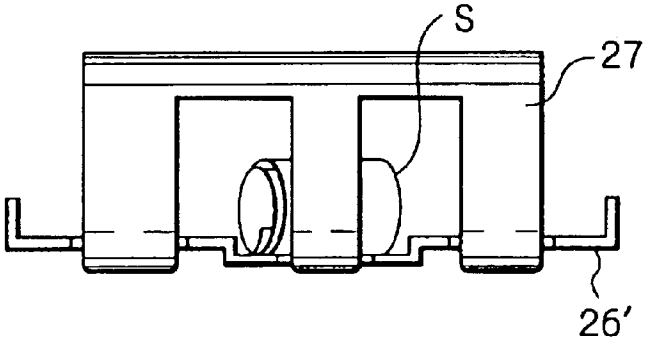
FIG. 16 is a view showing an anti-twist mechanism representative of an eighth embodiment of the present invention.

As shown in FIG. 16, an eighth embodiment of the present invention includes a first tray 26' intersecting the roll-up guide 27. The tray 26' includes a wire or guide rod formed with steps in accordance with the widthwise dimension of the sheet S. The tray 26', serving as the inlet of the guide 27 at the same time, restricts the sheet S with the above steps in the widthwise direction of the sheet S, thereby preventing the sheet S from twisting. A plurality of trays 26' each having steps corresponding to a particular sheet size may be prepared beforehand, if desired. Alternatively, a single tray 26' may be formed with various steps each corresponding to a particular sheet size.

Ninth Embodiment

Figure 17B:
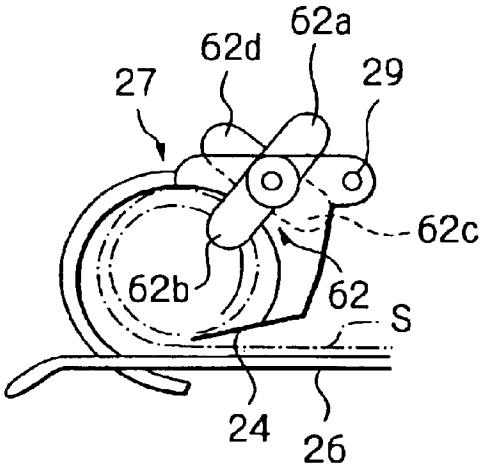
FIGS. 17A and 17B are views showing an anti-twist mechanism representative of a ninth embodiment of the present invention.
Figure 17A:
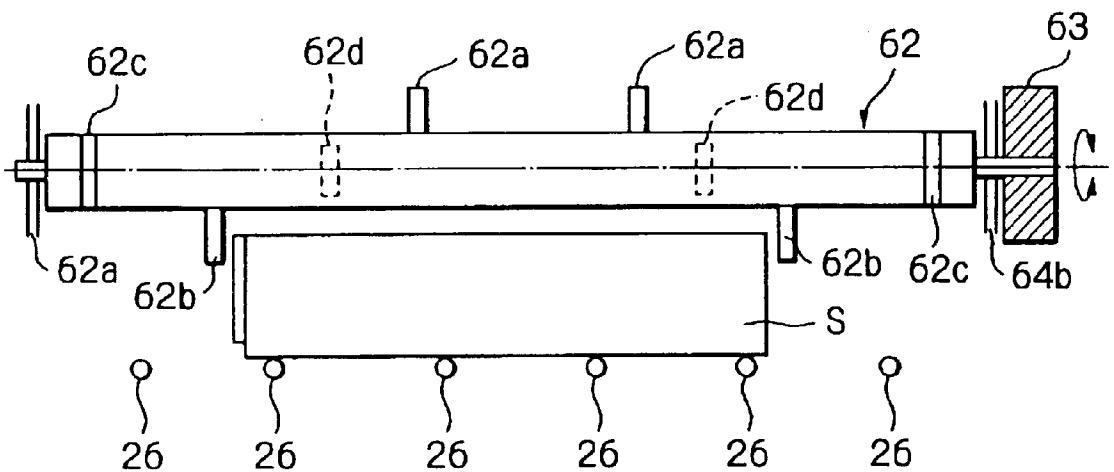

FIG. 17A is a section showing the roll-up guide 27 representative of a ninth embodiment of the present invention and including an anti-twist member 62. FIG. 17B is a side elevation of the roll-up guide 27. As shown, the anti-twist member 62 is rotatably supported between end walls 64*a* and 64*b* of the guide 27. Pairs of blades 62*a* through 62*d* are mounted on the circumference of the anti-twist member 62, and each is located at a position corresponding to a particular sheet size. A knob 63 with a click mechanism is mounted on a shaft supporting the anti-twist member 62. By operating the knob 63, the operator is capable of causing any one of the blade pairs 62*a* through 62*d* to protrude into the guide 27 and restrict the sheet in the widthwise direction. When the operator intends to pickup the rolled sheet S, the operator positions the anti-twist member 62 such that none of the blade pairs 62*a* through 62*d* protrudes into the guide 27.

When the sheet S is rolled up in the roll-up guide 27, the diameter of the roll depends on the length, thickness, the coefficient of friction and so forth of the sheet S. In light of this, the anti-twist member 62 should preferably be mounted such that he blades 62*a* through 62*d* can deal with a sheet having the minimum diameter when rolled up.

In the embodiments shown and described, the rollers 14*a* and 14*b* are positioned within the device upstream of the outlet. Alternatively, the nip between the rollers 14*a* and 14*b* may be exposed to the outside, i.e., located outside of the outlet, so that the trailing edge of the sheet rolled up in the roll-up guide 27 can be spaced from the casing or outlet. In such a case, the trailing edge of the sheet driven out by the rollers 14*a* and 14*b* will not remain in the casing, but will immediately reach the first tray 26 or 34.

In the embodiments shown and described, the reading section 17 constitutes image reading means. The roll-up guide 27 constitutes storing means together with associated members. The rollers 14*a* and 14*b* constitute discharging means and conveying means together with the other rollers. The belt 37 constitutes external conveying means together with associated members. The Mylar sheet 23 and first tray 26 constitute guiding means. The first tray 26 constitutes straight storing means. The switch 33 constitutes sensing means. The second discharge guide constitutes reversal guiding means. The outside guide 35*a* forms a guide portion while the cylinder 35*c* forms a hollow cylindrical storing portion. The operation panel 11 constitutes setting means.

The anti-twist member 61 or 62 plays the role of width restricting means. The pins 61*a* constitute a pair of projections. The blades 62*a* through 62 constitute a plurality of pairs of projections. The second tray 12 serves as top storing means. The second discharge guide and rollers 15*a* and 15*b* constitute reversal discharging means. The path selector 22 constitutes switching means. The shaft 29 constitutes spacing means and connecting means. The lever 50, sensor 53 and lever motor 54 constitute roll-up space enlarging and reducing means.

The present invention is applicable to various kinds of devices of the type storing a discharged sheet in the form of a roll, spacing the trailing edge of the stored sheet from the device body, and allowing a person to pick up the rolled sheet at the position where the person is standing. For example, the present invention may be implemented as a storing device, a sheet conveying device or an image scanner or an image forming apparatus including the sheet conveying device.

In summary, it will be seen that the present invention provides a sheet conveying device with a storage having various unprecedented advantages, as enumerated below.

(1) Roll-up storing means (roll-up guide) is connectable to the sheet conveying device such that when the storing means is shifted, the trailing edge of a sheet rolled up in the storing means is spaced from the conveying device. The trailing edge can therefore be surely pulled out of an outlet included in the conveying device. This protects the trailing edge from damage when it is picked up.

(2) Roll-up space enlarging and reducing means selectively enlarges or reduces a space for accommodating the sheet in the form of a roll in accordance with the kind of the sheet. The trailing edge of the sheet can therefore be surely pulled out of the device body. Further, a space matching with the kind of the sheet, e.g., hardness dependent on the thickness of the sheet can be guaranteed. For example, it is possible to reduce the diameter of the space as far as possible at the beginning of rolling and then increase the diameter as the diameter the sheet roll increases. This prevents a thin sheet from being folded down and prevents a thick sheet from collapsing due to friction between it and the roll-up storing means and jamming the storing means.

(3) As the length of the sheet rolled up increases, the roll-up space is increased in the diametrical direction of the roll. This prevents an occurrence that friction between the roll-up storing means and the sheet increases with an increase in the diameter of the roll and causes the sheet to jam the storing means.

(4) External conveying means conveys the sheet driven out of the device up to the roll-up storing means. The trailing edge of the sheet can therefore be spaced from the device body and is protected from damage when the sheet is picked up.

(5) When the sheet is driven out toward the roll-up storing means, the conveyance is accelerated. This, coupled with the fact that the trailing edge of the sheet is spaced from the device body, prevents the trailing edge of the sheet from being damaged when the sheet is picked up.

(6) The roll-up storing means and discharging means, which includes roller pairs, are spaced from each other. This also protects the trailing edge of the sheet from damage.

(7) The roll-up storing means is movable between a roll-up position for rolling up the sheet and a pick-up position for allowing the roll to be picked up by hand. This also protects the trailing edge of the sheet from damage. Further, the operator of the device can easily pickup the rolled sheet at an operating position, e.g., at the front of the device.

(8) The operator shifts the roll-up storing means by gripping a knob mounted on the storing means and can therefore shift it in the same direction as the operator picks up the rolled sheet.

(9) Guiding means (Mylar sheet fitted on a path selector and part of a first tray) guides the sheet to the inlet of the roll-up storing means located at the roll-up position. The sheet can therefore be surely guided to the storing means and prevented from curling and jamming the device.

(10) When the roll-up storing means is brought to the pick-up position, the inlet of the storing means faces upward and allows the operator to easily pick up the rolled sheet.

(11) The roll-up storing means includes a Mylar sheet openably covering part of the inlet. Therefore, even when the inlet of the storing means faces downward at the roll-up position, the Mylar sheet prevents the sheet from dropping. At the pick-up position, the Mylar sheet can be readily opened to pick up the rolled sheet.

(12) Part of straight storing means serves as the inlet of the roll-up storing means at the same time. This not only insures the guide of the sheet to the roll-up storing means, but also simplifies the construction.

(13) The roll-up storing means is rotatable about a shaft at the upper portion of the device. The storing means is therefore movable between the roll-up position at the back of the device to the pick-up position above the device. This allows the operator, standing at the front of the device, to pick up the rolled sheet in a direction identical with the operating direction.

(14) When the sheet is to be stored in the straight storing means, the roll-up storing means is retracted to the pick-up position with the result that a conveyance path including the straight storing means is unblocked. It follows that the sheet can be stored in a straight position or in a rolled position in the same direction via the same path, simplifying the configuration.

(15) The straight storing means includes intersection restricting means for restricting the intersection of the storing means with the roll-up storing means. This insures the space for accommodating the sheet in the roll-up storing means and thereby prevents the sheet from bending or tearing at the roll-up position.

(16) The device includes an upper unit and a lower unit openably hinged to each other. The roll-us storing means slides on the intersection restricting means in interlocked relation to the opening of the upper unit, while being restricted in its intersection with the straight storing means Therefore, when the upper unit is opened, it is possible to guarantee the roll-up space of the roll-up storing means at the roll-up position. This also prevents the sheet from bending or tearing.

(17) When sensing means responsive to the position of the roll-up storing means determines that the storing means is located at the pick-up position, a roller pair is caused to nip the trailing edge of the sheet. Therefore, when a thick, elongate sheet is discharged in a straight position, it is prevented from dropping to the floor.

(18) The device is operable in any one of a roll-up mode for rolling up the sheet in the roll-up storing means, a straight discharge mode (rear discharge mode) for discharging the sheet to the straight storing means (first tray), and a top discharge mode (front discharge mode) for discharging the sheet to top storing means (second tray). When the straight discharge mode or the roll-up mode is selected, switching means (path selector) switches a direction of conveyance to discharging means. The sheet can therefore be automatically discharged in a particular path matching with the kind of the sheet. Further, because the operator can select any one of the above modes, the sheet can be efficiently discharged in accordance with the kind of the sheet.

(19) Sensing means responsive to the position of the roll-up storing means is provided. When the operator selects the straight discharge mode on setting means, but the sensing means does not sense the roll-up storing means at the pick-up position, the straight discharge mode is inhibited. This prevents a thick sheet from being delivered to the roll-up storing means and damaged due to erroneous operation.

(20) When the sheet is rolled up in the storing means, width restricting means restricts the sheet in the widthwise direction. This prevents the sheet being rolled from skewing or collapsing due to a change in load and thereby obviates defective rolling At the same time, the operator is freed from extra work after the pick-up of the rolled sheet. Further, the width restricting means operates in accordance with the sheet size, so that the roll-up storing means does not have to be replaced sheet size by sheet size.

(21) The sheet is rolled up with its image surface positioned inside, so that an image is free from scratches when the sheet is picked up.

(22) The roll-up storing means has an inner periphery having an arcuate cross-section. Therefore, the sheet entered the storing means rises along the above inner periphery and then falls due to its own weight and can therefore be easily rolled up. Because the roll-up storing means is open at its inlet and opposite ends, the operator can pick up the rolled sheet from the above or the side of the storing means without moving away-from the operating position. Further, when the roll-up space is increased or decreased, the arcuate shape of the roll-up storing means allows the diameter of the above space to be readily enlarged or reduced.

(23) The roll-up storing means is rotatably supported by a shaft and includes a guide portion inclined toward the front of the device, and a hollow cylindrical storage portion contiguous with the upper end of the guide portion. The storing means rolls up the sheet, which has been reversed, at a position above the top of the device. The storing means is movable between a position for rolling up the sheet delivered into the storage portion and a position for discharging it along the outer periphery of the guide portion and storage portion. The storing means can therefore be easily, surely shifted to a front discharge position or a roll-up position. Further, the storing means does not have to be shifted from the rear to the front. Moreover, the operator can pick up the rolled sheet at the operating position. In addition, because a person operates the device and picks up the rolled sheet at the same position, the device can be installed in a smaller space than conventional devices.

(24) When the device is mounted on an image forming apparatus, the trailing edge of the sheet can be surely pulled out of the apparatus without any damage. By shifting the roll-up storing means to the position above the device, the operator can easily pick up the rolled sheet at the operating position. Again, the device can be installed in a smaller space than conventional devices.

(25) In an image reading device of the type discharging the sheet, which it has read, face up, the roll-up storing means rolls up the sheet with the image surface of the sheet being positioned inside and stores in the form of a roll. This also protects the image of the sheet from scratches when the rolled sheet is picked up.

Various modifications will become possible for those skilled in the art after receiving the teachings of the present disclosure without departing from the scope thereof.

What is claimed is:

1. A sheet storage to be mounted to a sheet conveying device for conveying and discharging a sheet, said sheet storage comprising:

roll-up storing means for receiving, in cooperation with an adjacent straight storage tray, the sheet discharged from the sheet conveying device, rolling up said sheet from a leading edge of said sheet, and storing said sheet in a form of a roll; and connecting means for displaceably connecting said roll-up storing means to the sheet conveying device;

wherein said roll-up storing means is connected to the sheet conveying device such that when said roll-up storing means is displaced, a trailing edge of the sheet rolled up in said roll-up storing means is spaced from said sheet conveying device.

2. A sheet conveying device comprising:

roll-up storing means for rolling up, in cooperation with an adjacent straight storage tray, a sheet being discharged from said sheet conveying device from a leading edge of said sheet and storing said sheet in a form of a roll; and spacing means for spacing a trailing edge of the sheet rolled up in said storing means from a body of said sheet conveying device;

wherein the sheet is picked up from said roll-up storing means with the trailing edge of said sheet spaced from said body.

3. A device as claimed in claim 2, wherein said roll-up storing means has an inner periphery having an arcuate cross-section in a direction of sheet conveyance, an inlet extending in a widthwise direction of the sheet, and opposite open ends in said widthwise direction.

4. A sheet conveying device comprising:

roll-up storing means for rolling up, in cooperation with an adjacent straight storage tray, a sheet being discharged from said sheet conveying device from a leading edge of said sheet and storing said sheet in a form of a roll;

discharging means for discharging the sheet to an outside of said sheet conveying device; and speed control means for controlling a speed at which said discharging means conveys the sheet;

wherein when the sheet is discharged toward said roll-up storing means, said speed control means increases the speed to thereby space a trailing edge of said sheet rolled up in said roll-up storing means from said discharging means.

5. A device as claimed in claim 4, wherein said roll-up storing means has an inner periphery having an arcuate cross-section in a direction of sheet conveyance, an inlet extending in a widthwise direction of the sheet, and opposite open ends in said widthwise direction.

6. A sheet conveying device comprising:

roll-up storing means for rolling up, in cooperation with an adjacent straight storage tray, a sheet being discharged from said sheet conveying device from a leading edge of said sheet and storing said sheet in a form of a roll;

discharging means for discharging the sheet to an outside of said sheet conveying device; and spacing means for spacing said roll-up storing means from said discharging means to thereby space a trailing edge of the sheet rolled up in said roll-up storing means from said discharging means.

7. A device as claimed in claim 6, wherein said toll-up storing means has an inner periphery having an arcuate cross-section in a direction of sheet conveyance, an inlet extending in a widthwise direction of the sheet, and opposite open ends in said widthwise direction.

8. A sheet conveying device comprising:

discharging means for discharging a sheet to an outside of said sheet conveying device; and roll-up storing means for rolling up, in cooperation with an adjacent straight storage tray, the sheet at an outside of said sheet conveying device and storing said sheet in a form of a roll;

wherein said roll-up storing means is movable between a roll-up position for rolling up the sheet and a pick-up position for allowing a person to pick up said sheet at an operating position.

9. A device as claimed in claim 8, wherein the person moves said roll-up storing means by gripping a knob mounted on said roll-up storing means.

10. A device as claimed in claim 9, further comprising:

sensing means for sensing a position of said roll-up storing means; and rollers constituting said discharging means;

wherein when said sensing means senses said roll-up storing means located at the pick-up position, said rollers nip a trailing edge of the sheet.

11. A device as claimed in claim 8, further comprising guiding means for guiding the sheet driven out via an outlet to an inlet included in said roll-up storing means.

12. A device as claimed in claim 11, further comprising:

sensing means for sensing a position of said roll-up sorting means; and roller constituting said discharging means;

wherein when said sensing means senses said roll-up storing means located at the pick-up position, said rollers nips a trailing edge of the sheet.

13. A device as claimed in claim 8, wherein said inlet of said roll-up storing means faces upward at the pick-up position.

14. A device as claimed in claim 13, wherein said roll-up storing means is rotatable such that said inlet, adjoining said discharging means at the roll-up position, faces upward at said pick-up position.

15. A device as claimed in claim 14, further comprising:

sensing means for sensing a position of said roll-up storing means; and rollers constituting said discharging means;

wherein when said sensing means senses said roll-up sorting means located at the pick-up position, said rollers nip a trailing edge of the sheet.

16. A device as claimed in claim 13, further comprising:

sensing means for sensing a position of said roll-up sorting means; and roller constituting said discharging means;

wherein when said sensing means senses said roll-up storing means located at the pick-up position, said rollers nip a trailing edge of the sheet.

17. A device as claimed in claim 8, wherein said roll-up storing means includes a Mylar sheet openably covering part of said inlet.

18. A device as claimed in claim 17, further comprising:

sensing means for sensing a position of said roll-up storing means; and rollers constituting said discharging means;

wherein when said sensing means senses said roll-up storing means located at the pick-up position, said rollers nip a trialing edge of the sheet.

19. A device as claimed in claim 8, further comprising straight storing means for storing the sheet in a straight position at an outside of said device, part of said straight storing means serving as said inlet of said roll-up storing means.

20. A device as claimed in claim 19, further comprising:

sensing means for sensing a position of said roll-up storing means; and rollers constituting said discharging means;

wherein when said sensing means senses said roll-up storing means located at the pick-up position, said rollers nip a trailing edge of the sheet.

21. A device as claimed in claim 8, wherein said roll-up storing means is rotatable about a shaft in an upper portion of said device between a roll-up position, which adjoins said discharging means at a rear of said device, and a pick-up position above said device.

22. A device as claimed in claim 21, further comprising:

sensing means for sensing a position of said roll-up storing means; and rollers constituting said discharging means;

wherein when said sensing means senses said roll-up storing means located at the pick-up position, said rollers nip a trailing edge of the sheet.

23. A device as claimed in claim 8, further comprising:

sensing means for sensing a position of said roll-up storing means; and rollers constituting said discharging means;

wherein when said sensing means senses said roll-up storing means located at the pick-up position, said rollers nip a trialing edge of the sheet.

24. A device as claimed in claim 8, wherein said roll-up storing means has an inner periphery having an arcuate cross-section in a direction of sheet conveyance, an inlet extending in a widthwise direction of the sheet, and opposite open ends in said direction.

25. A sheet conveying device for discharging a sheet inserted into a front of said sheet conveying device via discharging means positioned at a rear of said sheet conveying device, said sheet conveying device comprising:

straight storing means protruding to the rear of said sheet conveying device for storing the sheet driven out of said discharging means in a straight position; and roll-up storing means rotatable about a shaft in an upper portion of said sheet conveying device between a roll-up position, where said roll-up storing means intersects said straight storing means for cooperating with the straight storing means in rolling up the sheet, and a pick-up position above said sheet conveying device;

wherein when the sheet is to be stored in said straight storing means, said roll-up storing means is rotated about said shaft to said pick-up position to thereby unblock a conveyance path, which includes said straight storing means.

26. A device as claimed in claim 25, wherein said straight storing means includes intersection restricting means for restricting intersection of said straight storing means with said roll-up storing means such that, said roll-up storing means and said straight storing means work in cooperation to form a roll-up space within the roll-up storing means for rolling up the sheet.

27. A device as claimed in claim 26, further comprising:

sensing means for sensing a position of said roll-up storing means; and rollers constituting said discharging means;

wherein when said sensing means senses said roll-up storing means located at the pick-up position, said roller nip a trailing edge of the sheet.

28. A device as claimed in claim 26, further comprising:

reverse discharging means for reversing the sheet inserted from the front of said device and then discharging said sheet to a position above said device;

top storing means for storing the sheet discharged by said reverse discharging means to said position;

switching means for switching a direction of sheet conveyance to either one of said discharging means and said reversal discharging means; and setting means for allowing a person to set desired one of a roll-up mode for causing said roll-up storing means to roll up the sheet, a straight discharge mode for delivering said sheet to said straight storing means in a straight position, and a top discharge mode for delivering said sheet to said top storing means;

wherein when the person sets either one of the straight discharge mode and the roll-up mode, said switching means switches the direction of sheet conveyance to said discharging means.

29. A device as claimed in claim 26, further comprising:

sensing means for sensing a position of said roll-up storing means; and setting means for allowing a person to selectively set a roll-up mode for causing said roll-up storing means to roll up the sheet and a straight discharge mode for delivering said sheet to said straight storing means;

wherein when the person sets the straight discharge mode, but said sensing means does not sense said roll-up storing means at the pick-up position, said straight discharge mode is inhibited.

30. A device as claimed in claim 25, further comprising:

sensing means for sensing a position of said roll-up storing means; and rollers constituting said discharging means;

wherein when said sensing means senses said roll-up storing means located at the pick-up position, said rollers nip a trailing edge of the sheet.

31. A device as claimed in claim 25, further comprising:

reverse discharging means for reversing the sheet inserted from the front of said device and then discharging said sheet to a position above said device;

top storing means for storing the sheet discharged by said reverse discharging means to said position;

switching means for switching a direction of sheet conveyance to either one of said discharging means and said reversal discharging means; and setting means for allowing a person to set desired one of a roll-up mode for causing said roll-up sorting means to roll up the sheet, a straight discharge mode for delivering said sheet to said straight storing means in a straight position, and a top discharge mode for delivering said sheet to said top storing means;

wherein when the person sets either one of the straight discharge mode and the roll-up mode, said switching means switches the direction of sheet conveyance to said discharging means.

32. A device as claimed in claim 25, further comprising:

sensing means for sensing a position of said roll-up sorting means; and setting means for allowing a person to selectively set a roll-up mode for causing said roll-up storing means to roll up the sheet and a straight discharge mode for delivering said sheet to said straight storing means in a straight position;

wherein when the person sets the straight discharge mode, but said sensing means does not sense said roll-up storing means at the pick-up position, said straight discharge mode is inhibited.

33. A device as claimed in claim 25, wherein said roll-up storing means has an inner periphery having an arcuate cross-section in a direction of sheet conveyance, an inlet extending in a widthwise direction of the sheet, and opposite open ends in said widthwise direction.

34. A sheet conveying device made up of an upper unit and a lower unit openably connected to each other, said sheet conveying device comprising:

straight storing means for storing a sheet discharged at an outside of said lower unit;

roll-up storing means rotatably supported by said upper unit for cooperating with the straight storing means in selectively rolling up, at a position where said roll-up storing means intersects said straight storing means, the sheet entered said straight storing means and an inner periphery of said roll-up storing means; and intersection restricting means included in said straight storing means for restricting intersection of said straight storing means with said roll-up storing means;

wherein said roll-up storing means slides on said intersection restricting means in interlocked relation to opening of said upper unit away from said lower unit to be thereby restricted intersection thereof with said straight storing means.

35. A device as claimed in claim 34, wherein said roll-up storing means has an inner periphery having an arcuate cross-section in a direction of sheet conveyance, an inlet extending in a widthwise direction of the sheet, and opposite open ends in said widthwise direction.

36. In a sheet conveying device for conveying a sheet having an image surface to a reading device and discharging said sheet having been read by said reading device, roll-up storing means for cooperating with an adjacent straight storage device to roll up said sheet discharged with said image surface being positioned inside to thereby store said sheet in a form of a roll.

37. A device as claimed in claim 36, wherein said roll-up storing means has an inner periphery having an arcuate cross-section in a direction of sheet conveyance, an inlet extending in a widthwise direction of the sheet, and opposite open ends in said widthwise direction of said sheet.

38. In an image reading device with a sheet conveying device mounted thereon, said sheet conveying device comprises:

roll-up storing means for receiving, in cooperation with an adjacent straight storage tray, the sheet discharged from the sheet conveying device, rolling up said sheet from a leading edge of said sheet, and storing said sheet in a form of a roll; and connecting means for displaceably connecting said roll-up storing means to the sheet conveying device;

wherein said roll-up storing means is connected to the sheet conveying device such that when said roll-up storing means is displaced, a trailing edge of the sheet rolled up in said roll-up storing means is spaced from said sheet conveying device.

39. In an image reading device with a sheet conveying device mounted thereon, said sheet conveying device comprises:

roll-up storing means for rolling up, in cooperation with an adjacent straight storage tray, a sheet being discharged from said sheet conveying device from a leading edge of said sheet and storing said sheet in a form of a roll; and spacing means for spacing a trailing edge of the sheet rolled up in said storing means from a body of said sheet conveying device;

wherein the sheet is picked up from said roll-up storing means with the trailing edge of said sheet spaced from said body.

40. In an image reading device with a sheet conveying device mounted thereon, said sheet conveying device comprises:

roll-up storing means for rolling up, in cooperation with an adjacent straight storage tray, a sheet being discharged from said sheet conveying device from a leading edge of said sheet and storing said sheet in a form of a roll;

discharging means for discharging the sheet to an outside of said sheet conveying device; and speed control means for controlling a speed at which said discharging means conveys the sheet;

wherein when the sheet is discharged toward said roll-up storing means, said speed control means increases the speed to thereby space a trailing edge of said sheet rolled up in said roll-up storing means from said discharging means.

41. In an image reading device with a sheet conveying device mounted thereon, said sheet conveying device comprises:

roll-up storing means for rolling up, in cooperation with an adjacent straight storage tray, a sheet being discharged from said sheet conveying device from a leading edge of said sheet and storing said sheet in a form of a roll;

discharging means for discharging the sheet to an outside of said sheet conveying device; and spacing means for spacing said roll-up storing means from said discharging means to thereby space a trailing edge of the sheet rolled up in said roll-up storing means from said discharging means.

42. In an image reading device with a sheet conveying device mounted thereon, said sheet conveying device comprises:

discharging means for discharging a sheet to an outside of said sheet conveying device; and roll-up storing means for rolling up, in cooperation with an adjacent straight storage tray, the sheet at an outside of said sheet conveying device and storing said sheet in a form of a roll;

wherein said roll-up storing means is movable between a roll-up position for rolling up the sheet and a pick-up position for allowing a person to pick up said sheet at an operating position.

43. In an image reading device with a sheet conveying device mounted thereon, said sheet conveying device comprises:

straight storing means for storing a sheet discharged at an outside of said lower unit;

roll-up storing means rotatably supported by said upper unit for cooperating with said straight storing means in selectively rolling up, at a position where said roll-up storing means intersects said straight storing means, the sheet entered said straight storing means with an inner periphery of said roll-up storing means; and intersection restricting means included in said straight storing means for restricting intersection of said straight storing means with said roll-up storing means;

wherein said roll-up storing means slides on said intersection restricting means in interlocked relation to an opening of said upper unit away from said lower unit to be thereby restricted intersection thereof with said straight storing means.

44. In an image reading device with a sheet conveying device mounted thereon, said sheet conveying device comprises:

roll-up storing means for cooperating with an adjacent straight storage tray to roll up said sheet discharged with said image surface being positioned inside to thereby store said sheet in a form of a roll.

45. In an image reading device with a sheet conveying device mounted thereon, said sheet conveying device comprises:

roll-up storing means for receiving, in cooperation with an adjacent straight storage tray, the sheet discharged from the sheet conveying device, rolling up said sheet from a leading edge of said sheet, and storing said sheet in a form of a roll; and connecting means for displaceably connecting said roll-up storing means to the sheet conveying device; wherein said roll-up storing means is connected to the sheet conveying device such that when said roll-up storing means is displaced, a trailing edge of the sheet rolled up in said roll-up storing means is spaced from said sheet conveying device.

46. An image reading device including image reading means for reading an image surface of a sheet from above said sheet, said image reading device comprising:

discharging means for discharging the sheet having been read face up; and roll-up storing means cooperative with an adjacent straight storage tray in rolling up the sheet discharged by said discharging means with the image surface being positioned inside and storing said sheet in a form of a roll.

47. A sheet storage to be mounted to a sheet conveying device for conveying and discharging a sheet, said sheet storage comprising:

a roll-up storage configured to receive, in cooperation with an adjacent straight storage tray, the sheet discharged from the sheet conveying device, roll up said sheet from a leading edge of said sheet, and store said sheet in a form of a roll; and a connecting member configured to displaceably connect said roll-up storage to the sheet conveying device;

wherein said roll-up storage is connected to the sheet conveying device such that when said roll-up storage is displaced, a trailing edge of the sheet rolled up in said roll-up storage is spaced from said sheet conveying device.

48. A sheet conveying device comprising:

a roll-up storage configured to roll up a sheet being discharged from said sheet conveying device, in cooperation with an adjacent straight storage tray, from a leading edge of said sheet and store said sheet in a form of a roll; and a spacing member configured to space a trailing edge of the sheet rolled up in said roll-up storage from a body of said, sheet conveying device;

wherein the sheet is picked up from said roll-up storage with the trailing edge of said sheet spaced from said body.

49. A device as claimed in claim 48, wherein said roll-up storage has an inner periphery having an arcuate cross-section in a direction of sheet conveyance, an inlet extending in a widthwise direction of the sheet, and opposite open ends in said widthwise direction.

50. A sheet conveying device comprising:

a roll-up storage configured to roll up, in cooperation with an adjacent straight storage tray, a sheet being discharged from said sheet conveying device from a leading edge of said sheet and store said sheet in a form of a roll;

a discharging member configured to discharge the sheet to an outside of said sheet conveying device; and a speed controller constructed to control a speed at which the discharging member conveys the sheet;

wherein when the sheet is discharged toward said roll-up storage, said speed controller increases the speed to thereby space a trailing edge of said sheet rolled up in said roll-up storage from said discharging member.

51. A sheet conveying device comprising:

a roll-up storage configured to roll up a sheet being discharged from said sheet conveying device from a leading edge of said sheet and store said sheet in a form of a roll;

a discharging member configured to discharge the sheet to an outside of said sheet conveying device; and a spacing member for spacing said roll-up storage from said discharging member to thereby space a trailing edge of the sheet rolled up in said roll-up storage from said discharging member.

52. A sheet conveying device comprising:

a roll-up storage configured to roll up, in cooperation with an adjacent straight storage tray, a sheet being discharged from said sheet conveying device from a leading edge of said sheet and store said sheet in a form of a roll;

a discharging member configured to discharge the sheet to an outside of said sheet conveying device; and a spacing member for spacing said roll-up storage from said discharging member to thereby space a trailing edge of the sheet rolled up in said roll-up storage from said discharging member.

53. A device as claimed in claim 52, wherein said roll-up storage has an inner periphery having an arcuate cross-section in a direction of sheet conveyance, an inlet extending in a widthwise direction of the sheet, and opposite open ends in said widthwise direction.

54. A sheet conveying device comprising:

a discharging member configured to discharge a sheet to an outside of said sheet conveying device; and a roll-up storage configured to roll up, in cooperation with an adjacent straight storage tray, the sheet at an outside of said sheet conveying device and store said sheet in a form of a roll;

wherein said roll-up storage is movable between a roll-up position for rolling up the sheet and a pick-up position for allowing a person to pick up said sheet at an operating position.

55. A device as claimed in claim 54, wherein the person moves said roll-up storage by gripping a knob mounted on said roll-up storage.

56. A device as claimed in claim 55, further comprising:

a sensor responsive to a position of said roll-up storage; and rollers constituting said discharging member;

wherein when said sensor senses said roll-up storage located at the pick-up position, said rollers nip a trailing edge of the sheet.

57. A device as claimed in claim 54, further comprising a guide configured to guide the sheet driven out via an outlet to an inlet included in said roll-up storage.

58. A device as claimed in claim 57, further comprising:

a sensor responsive to a position of said roll-up storage; and rollers constituting said discharging member;

wherein when said sensor senses said roll-up storage located at the pick-up position, said rollers nips a trialing edge of the sheet.

59. A device as claimed in claim 54, wherein said inlet of said roll-up storage faces upward at the pick-up position.

60. A device as claimed in claim 59, wherein said roll-up storage is rotatable such that said inlet, adjoining said discharging member at the roll-up position, faces upward at said pick-up position.

61. A device as claimed in claim 60, further comprising:

a sensor responsive to a position of said roll-up storage; and rollers constituting said discharging member;

wherein when said sensor senses said roll-up storage located at the pick-up position, said rollers nip a trailing edge of the sheet.

62. A device as claimed in claim 59, further comprising:

a sensor responsive to a position of said roll-up storage; and rollers constituting said discharging member;

wherein when said sensor senses said roll-up storage located at the pick-up position, said rollers nip a trailing edge of a trailing edge of the sheet.

63. A device as claimed in claim 54, wherein said roll-up storage includes a Mylar sheet openably covering part of said inlet.

64. A device as claimed in claim 63, further comprising:

a sensor responsive to a position of said roll-up storage, and rollers constituting said discharging member;

wherein when said sensor senses said roll-up storage located at the pick-up position, said rollers nip a trailing edge of the sheet.

65. A device as claimed in claim 54, further comprising a straight storage configured to store the sheet in a straight position at an outside of said device, part of aid straight storage serving as said inlet of said roll-up storage.

66. A device as claimed in claim 65, further comprising:

a sensor responsive to a position of said roll-up storage; and rollers constituting said discharging member;

wherein when said sensor senses said roll-up storage located at the pick-up position, said rollers nip a trailing edge of the sheet.

67. A device as claimed in claim 54, wherein said roll-up storage is rotatable about a shaft in an upper portion of said device between a roll-up position, which adjoins said discharging member at a rear of said device, and a pick-up position above said device.

68. A device as claimed in claim 67, further comprising:

a sensor responsive to a position of said roll-up storage; and rollers constituting said discharging member;

wherein when said sensor senses said roll-up storage located at the pick-up position, said rollers nip a trailing edge of the sheet.

69. A device as claimed in claim 54, further comprising:

a sensor for sensing a position of said roll-up storage; and rollers constituting said discharging member;

wherein when said sensor senses said roll-up storage located at the pick-up position, said rollers nip a trailing edge of the sheet.

70. A device as claimed in claim 54, wherein said roll-up storage has an inner periphery having an arcuate cross-section in a direction of sheet conveyance, an inlet extending in a widthwise direction of the sheet, and opposite open ends in said widthwise direction.

71. A sheet conveying device for discharging a sheet inserted into a front of said sheet conveying device via a discharging member positioned at a rear of said sheet conveying device, said sheet conveying device comprising:

a straight storage protruding to the rear of said sheet conveying device for storing the sheet driven out of said discharging member in a straight position; and a roll-up storage rotatable about a shaft in an upper portion of said sheet conveying device between a roll-up position, where said roll-up storage intersects said straight storage and cooperates with the straight storage for rolling up the sheet, and a pick-up position above said sheet conveying device;

wherein when the sheet is to be stored in said straight storage, said roll-up storage is rotated about said shaft to said pick-up position to thereby unblock a conveyance path, which includes said straight storage.

72. A device as claimed in claim 71, wherein said straight storage includes an intersection restricting member for restricting intersection of said straight storage with said roll-up storage such that, said roll-up storage and said straight storage work in cooperation to form a roll-up space within the roll-up storage for rolling up the sheet.

73. A device as claimed in claim 72, further comprising:

a sensor responsive to a position of said roll-up storage; and rollers constituting said discharging member;

wherein when said sensor senses said roll-up storage located at the pick-up position, said rollers nip a trailing edge of the sheet.

74. A device as claimed in claim 72, further comprising:

a reverse discharging member configured to reverse the sheet inserted from the front of said device and then discharging said sheet to a position above said device;

a top storage configured to store the sheet discharged by said reverse discharging member to said position;

a switching member configured to switch a direction of sheet conveyance to either one of said discharging member and said reversal discharging member; and a setting section constructed to allow a person to set desired one of a roll-up mode for causing said roll-up storage to roll up the sheet, and straight discharge mode for delivering said sheet to said straight storage in a straight position, and a top discharge mode for delivering said sheet to said top storage;

wherein when the person sets either one of the straight discharge mode and the roll-up mode, said switching member switches the direction of sheet conveyance to said discharging member.

75. A device as claimed in claim 72, further comprising:

a sensor responsive to a position of said roll-up storage; and a setting section constructed to allow a person to selectively set a roll-up mode for causing said roll-up storage to roll up the sheet and a straight discharge mode for delivering said sheet to said straight storage;

wherein when the person sets the straight discharge mode, but said sensor does not sense said roll-up storage at the pick-up position, said straight discharge mode is inhibited.

76. A device as claimed in claim 71, further comprising:

a sensor responsive to a position of said roll-up storage; and rollers constituting said discharging member;

wherein when said sensor senses said roll-up storage located at the pick-up position, said rollers nip a trailing edge of the sheet.

77. A device as claimed in claim 71, further comprising:

a reverse discharging member configured to reverse the sheet inserted from the front of said device and then discharging said sheet to a position above said device;

a top storage configured to store the sheet discharged by said reverse discharging member to said position;

a switching member configured to switch a direction of sheet conveyance to either one of said discharging member and said reversal discharging member; and a setting section constructed to allow a person to set desired one of a roll-up mode for causing said roll-up storage to roll up the sheet, a straight discharge mode for delivering said sheet to said straight storage in a straight position, and a top discharge mode for delivering said sheet to said top storage;

wherein when the person sets either one of the straight discharge mode and the roll-up mode, said switching member switches the direction of sheet conveyance to said discharging member.

78. A device as claimed in claim 71, further comprising:

a sensor responsive to a position of said roll-up storage; and a setting section constructed to allow a person to selectively set a roll-up mode for causing said roll-up storage to roll up the sheet and a straight discharge mode for delivering said sheet to said straight storage in a straight position;

wherein when the person sets the straight discharge mode, but said sensor does not sense said roll-up storage at the pick-up position, said straight discharge mode is inhibited.

79. A device as claimed in claim 71, wherein said roll-up storage has an inner periphery having an arcuate cross-section in a direction of sheet conveyance, an inlet extending in a widthwise direction of the sheet, and opposite open ends in said widthwise direction.

80. A sheet conveying device made up of an upper unit and a lower unit openably connected to each other, said sheet conveying device comprising:

a straight storage configured to store a sheet discharged at an outside of said lower unit;

a roll-up storage rotatably supported by said upper unit for cooperating with the straight storage in selectively rolling up, at a position where said roll-up storage intersects said straight storage, the sheet entered said straight storage and an inner periphery of said roll-up storage; and an intersection restricting member included in said straight storage for restricting intersection of said straight storage with said roll-up storage;

wherein said roll-up storage slides on said intersection restricting member in interlocked relation to opening of said upper unit away from said lower unit to be thereby restricted in intersection thereof with said straight storage.

81. A device as claimed in claim 80, wherein said roll-up storage has an inner periphery having an arcuate cross-section in a direction of sheet conveyance, an inlet extending in a widthwise direction of the sheet, and opposite open ends in said widthwise direction.

82. In a sheet conveying device for conveying a sheet having an image surface to a reading device and discharging said sheet having been read by said reading device, a roll-up storage cooperates with an adjacent straight storage tray to roll up said sheet discharged with said image surface being positioned inside to thereby store said sheet in a form of a roll.

83. A device as claimed in claim 82, wherein said roll-up storage has an inner periphery having an arcuate cross-section in a direction of sheet conveyance, an inlet extending in a widthwise direction of the sheet, and opposite open ends in said direction of said sheet.

84. In an image reading device with a sheet conveying device mounted thereon, said sheet conveying device comprises:

a roll-up storage configured to cooperate with an adjacent straight storage tray to roll up a sheet being discharged from said sheet conveying device from a leading edge of said sheet and storing said sheet in a form of a roll; and a spacing member configured to space a trailing edge of the sheet rolled up in said storage from a body of said sheet conveying device;

wherein the sheet is picked up from said roll-up storage with the trailing edge of said sheet spaced from said body.

85. In an image reading device with a sheet conveying device mounted thereon, said sheet conveying device comprises:

a roll-up storage configured to cooperate with an adjacent straight storage tray roll up a sheet being discharged from said sheet conveying device from a leading edge of said sheet and store said sheet in a form of a roll;

a discharging member for discharging the sheet to an outside of said sheet conveying device; and a speed controller constructed to control a speed at which said discharging member conveys the sheet;

wherein when the sheet is discharged toward said roll-up storage, said speed controller increases the speed to thereby space a trailing edge of said sheet rolled up in said roll-up storage from said discharging member.

86. In an image reading device with a sheet conveying device mounted thereon, said sheet conveying device comprises:

roll-up storage configured to cooperate with an adjacent straight storage tray roll up a sheet being discharged from said sheet conveying device from a leading edge of said sheet and store said sheet in a form of a roll;

a discharging member configured to discharge the sheet to an outside of said sheet conveying device; and a spacing member configured to space said roll-up storage from said discharging member to thereby space a trailing edge of the sheet rolled up in said roll-up storage from said discharging member.

87. In an image reading device with a sheet conveying device mounted thereon, said sheet conveying device comprises:

a discharging member configured to discharge a sheet to an outside of said sheet conveying device; and a roll-up storage configured to cooperate with an adjacent straight storage tray roll up the sheet at an outside of said sheet conveying device and store said sheet in a form of a roll;

wherein said roll-up storage is movable between a roll-up position for rolling up the sheet and a pick-up position for allowing a person to pick up said sheet at operating position.

88. In an image reading device with a sheet conveying device mounted thereon, said sheet conveying device comprises:

a straight storage protruding to the rear of said sheet conveying device and configured to store the sheet driven out of said discharging member in a straight position; and a roll-up storage configured to be rotatable about a shaft in an upper portion of said sheet conveying device between a roll-up position, where said roll-up storage intersects said straight storage and works in cooperation with the straight storage to roll up the sheet, and a pick-up position above said sheet conveying device;

wherein when the sheet is to be stored in said straight storage, said roll-up storage is rotated about said shaft to said pick-up position to thereby unblock a conveyance path, which includes said straight storage.

89. In an image reading device with a sheet conveying device mounted thereon, said sheet conveying device comprises:

a straight storage configured to store a sheet discharged at an outside of said lower unit;

a roll-up storage rotatably supported by said upper unit and configured to cooperate with said straight storage tray to selectively roll up, at a position where said roll-up storage intersects said straight storage, the sheet entered said straight storage with an inner periphery of said roll-up storage; and an intersection restricting member included in said straight storage and configured to restrict intersection of said straight storage with said roll-up storage;

wherein said roll-up storage slides on said intersection restricting member in interlocked, relation to opening of said upper unit away from said lower unit to be thereby restricted in intersection thereof with said straight storage.

90. In an image reading device with a sheet conveying device mounted thereon, said sheet conveying device comprises:

a roll-up storage configured to cooperate with an adjacent straight storage tray to roll up said sheet discharged with said image surface being positioned inside to thereby store said sheet in a form of a roll.

91. In an image reading device with a sheet conveying device mounted thereon, said sheet conveying device comprises:

a roll-up storage configured to cooperate with an adjacent straight storage tray to receive the sheet discharged from the sheet conveying device, roll up said sheet from a leading edge of said sheet, and store said sheet in a form of a roll; and a connecting member configured to displaceably connect said roll-up storage to the sheet conveying device;

wherein said roll-up storage is connected to the sheet conveying device such that when said roll-up storage is displaced, a trailing edge of the sheet rolled up in said roll-up storage is spaced from said sheet conveying device.

92. An image reading device including an image reading device for reading an image surface of a sheet from above said sheet, said image reading device comprising:

a discharging member configured to discharge the sheet having been read face up; and a roll-up storage configured to cooperate with an adjacent straight storage tray to roll up the sheet discharged by said discharging member with the image surface being positioned inside and store said sheet in a form of a roll.

* * * * *